US010907905B2

(12) United States Patent
Masgrau

(10) Patent No.: US 10,907,905 B2
(45) Date of Patent: Feb. 2, 2021

(54) PLATE FOR HEAT EXCHANGE ARRANGEMENT AND HEAT EXCHANGE ARRANGEMENT

(71) Applicant: AIREC AB, Malmö (SE)

(72) Inventor: Marcello Masgrau, Copenhagen (DK)

(73) Assignee: ALFA LAVAL CORPORATE AB, Lund (SE)

( * ) Notice: Subject to any disclaimer, the term of this patent is extended or adjusted under 35 U.S.C. 154(b) by 105 days.

(21) Appl. No.: 15/774,304

(22) PCT Filed: Nov. 10, 2016

(86) PCT No.: PCT/EP2016/077247
§ 371 (c)(1),
(2) Date: May 8, 2018

(87) PCT Pub. No.: WO2017/084959
PCT Pub. Date: May 26, 2017

(65) Prior Publication Data

US 2019/0212065 A1 Jul. 11, 2019

(30) Foreign Application Priority Data

Nov. 18, 2015 (EP) ..... 15195092

(51) Int. Cl.
*F28D 9/00* (2006.01)
*F28F 3/04* (2006.01)
(Continued)

(52) U.S. Cl.
CPC ..... *F28D 9/005* (2013.01); *F24H 1/32* (2013.01); *F28D 9/0056* (2013.01);
(Continued)

(58) Field of Classification Search
CPC ..... F28D 9/005; F28D 9/0043; F28D 9/0093; F28D 9/0012; F24H 1/32; F24H 8/00; F28F 13/08
See application file for complete search history.

(56) References Cited

U.S. PATENT DOCUMENTS

2001/0006103 A1 7/2001 Nash et al.
2005/0194123 A1 9/2005 Strahle et al.
(Continued)

FOREIGN PATENT DOCUMENTS

EP 2682703 1/2014
JP 2006214628 A * 8/2006
(Continued)

*Primary Examiner* — Eric S Ruppert
(74) *Attorney, Agent, or Firm* — Buchanan Ingersoll & Rooney PC

(57) ABSTRACT

A plate (1) for a heat exchange arrangement has a first heat transferring surface (A) with a protrusion (7) forming a continuous and closed ridge. This ridge divides said surface into a closed inner region (A1) and an outer region (A2). The inner region (A1) encloses a first inlet porthole (2) and a first outlet porthole (5) for a first medium. The outer region (A2) has a second inlet porthole (3) and a second outlet porthole (6) for the first medium. A heat exchange arrangement comprises a stack of first and second plates of the above type. The protrusions (7) on the first heat transferring surfaces (A) of said plates are connected to each other to separate first channels into first and second flow paths for the first medium. Each first flow path is configured to direct the first medium from a first inlet to a first outlet inside the inner region (A1) and each second flow path is configured to direct the first medium from a second inlet to a second outlet in the outer region (A2), said inlets and outlets being defined between said inlet and outlet portholes (2, 3 and 5, 6 respectively).

20 Claims, 25 Drawing Sheets

(51) Int. Cl.
*F28D 21/00* (2006.01)
*F24H 1/32* (2006.01)

(52) U.S. Cl.
CPC ..... *F28D 21/0007* (2013.01); *F28F 3/042* (2013.01); *F28F 3/044* (2013.01); *F28F 3/046* (2013.01); *F28F 2210/10* (2013.01); *F28F 2250/10* (2013.01); *F28F 2250/102* (2013.01)

(56) References Cited

U.S. PATENT DOCUMENTS

| | | | | |
|---|---|---|---|---|
| 2007/0089871 | A1 | 4/2007 | Anderson et al. | |
| 2012/0018127 | A1 | 1/2012 | Iwasaki | |
| 2016/0245591 | A1 | 8/2016 | Masgrau | |
| 2016/0377319 | A1 * | 12/2016 | Kim | F24H 1/165 122/18.31 |

FOREIGN PATENT DOCUMENTS

| | | | | |
|---|---|---|---|---|
| WO | 2015057115 | | 4/2015 | |
| WO | WO-2015141992 | A1 * | 9/2015 | F24H 8/00 |

* cited by examiner

PLATE FOR HEAT EXCHANGE ARRANGEMENT AND HEAT EXCHANGE ARRANGEMENT

RELATED APPLICATION

This application corresponds to PCT/EP2016/077247, filed Nov. 10, 2016, which corresponds to European Application No. 15195092.0, filed Nov. 18, 2015, the subject matter, of which are incorporated herein by reference in their entirety.

TECHNICAL FIELD

The present disclosure relates to plate for a heat exchange arrangement and a heat exchange arrangement for the exchange of heat between a first and a second medium.

BACKGROUND

Plates and heat exchange arrangements of the above-mentioned type are used to e.g. heat up tap water "on-demand" without storage tanks by combustion of fuel, typically gas. The water is then heated from about 20° C. to about 60° C. The gas is at the same time cooled by the tap water, i.e. the tap water is heated by the gas. Combustion gases must be cooled from about 1500° C. to as low temperature as possible. Condensation provides additional thermal energy from the fuel due to the release of latent heat. Water vapour from the combustion gases condenses when in contact with low temperature metal surfaces of the heat exchange arrangement. The temperature of the metal surfaces varies along the heat exchange arrangement and it is determined by the temperature and flow characteristics of water and gas at every location.

Thermal problems have previously prevented use of cost effective and compact heat exchange arrangements in particularly gas-fired hot water heaters and burners. The gas from the burner flowing into the heat exchange arrangement is as mentioned over 1500° C. and the variations in temperature are extremely quick. This can cause thermal stresses and leakage.

High metal temperatures lead to high water temperatures, which in turn lead to boiling risk and thus, risk for mechanical damage of the heat exchange arrangement. Other risks are scaling, fouling (precipitates from water that attach to the metal surface), causing danger of decreasing water cooling capacity and thus, the presence of a positive feedback loop towards higher metal temperatures over time. High metal temperatures also lead to high thermal stresses in the metal, which in turn can lead to formation of cracks and thus, failure (leakage) of the product.

Prior art plates for heat exchange arrangements and heat exchange arrangements such as those described and illustrated in e.g. US 2001/0006103 A1, EP 1700079 B1 and EP 2412950 A1, are not capable of solving the above-mentioned drawbacks and problems in a satisfactory manner.

Another prior art plate for a heat exchanger and a heat exchanger are disclosed in the international patent application publication WO 2015/057115 A1. The plate described in WO 2015/057115 A1 is for exchange of heat between a first and a second medium, wherein the plate has a first heat transferring surface arranged in use to be in contact with the first medium and a second heat transferring surface arranged in use to be in contact with the second medium. The plate is configured with a first inlet porthole for the first medium, an inlet porthole for the second medium and a first outlet porthole for the first medium.

SUMMARY

An object of the present disclosure is therefore to overcome or ameliorate at least one of the disadvantages and problems of the prior art, or to provide a useful alternative.

The above object may be achieved by the subject matter of claim 1, i.e. by means of the plate according to the present disclosure. The plate has a first heat transferring surface arranged in use to be in contact with the first medium and a second heat transferring surface arranged in use to be in contact with the second medium.

The plate is configured with a first inlet porthole for the first medium and an inlet porthole for the second medium as well as a first outlet porthole for the first medium. Further, the plate comprises at least a second inlet porthole for the first medium and at least a second outlet porthole for the first medium.

The first heat transferring surface of the plate is configured with at least one protrusion forming a continuous and closed ridge which is arranged to divide said heat transfer surface into at least a closed inner region and an outer region and this inner region completely encloses the first inlet porthole for the first medium, the first outlet porthole for the first medium and the inlet porthole for the second medium. The second inlet porthole for the first medium and the second outlet porthole for the first medium are located in the outer region.

The above object may be achieved also by the subject matter of claim 11, i.e. by means of the heat exchange arrangement according to the present disclosure. The arrangement comprises a plurality of first plates and a plurality of second plates as defined above. The second plates are mirror copies of the first plates and said first and said second plates are alternately stacked to form a repetitive sequence of a first channel for the first medium and a second channel for the second medium. Each first channel is defined by the first heat transferring surface of the first plate and the first heat transferring surface of the second plate and each second channel by the second heat transferring surface of the first plate and the second heat transferring surface of the second plate. The first and the second inlet portholes for the first medium on the first and the second plates define between them first and second inlets respectively, for the first medium. The first and the second outlet portholes for the first medium on the first and the second plates define between them first and second outlets respectively, for the first medium. The inlet portholes for the second medium on the first and the second plates define between them inlets for the second medium. The protrusions on the first heat transferring surfaces of the first and the second plates are connected to each other to separate each first channel into at least first and second flow paths for the first medium. Each first flow path is configured in use to direct a flow of the first medium from the first inlet to the first outlet inside the inner region and each second flow path is configured in use to direct the flow of the first medium from the second inlet to the second outlet in the outer region.

Thus, thanks to the plate as defined above and the heat exchange arrangement as defined above, comprising a plurality of such plates, such that the flow of the first medium can be fed twice through the first channel therefor, optimum cooling of the second medium and thus, of the metal surfaces of the plates of the heat exchange arrangement is achieved while at the same time optimum heating of the first medium for use is achieved.

Thanks to the plate as defined above and the heat exchange arrangement as defined above, it is also possible to keep the temperature of the metal surfaces at acceptable levels from a product reliability point of view all over the heat exchange arrangement and thereby eliminate the particular risks regarding thermal fatigue and leakage. The combustion gas inlet region is a particularly critical area due to the very high temperature of the combustion gas.

Furthermore, thanks to the present disclosure, a unique plate and thus, a unique, cost effective and compact heat exchange arrangement comprising such unique plates is provided for use in, inter alia, gas-fired hot water heaters and burners. Locating the burner in the burning chamber of a heating device comprising a heat exchange arrangement according to the present disclosure provides for a compact design and higher energy efficiency and extensive condensation is achieved by integrated cooling of the burning chamber and of the medium (gas) therein, which is used for heating the other medium (water).

The feeding of the first medium twice through the first channel therefor, is according to the present disclosure accomplished in a simple and cost effective manner by providing an external flow transition means. This external flow transition means can in an advantageous embodiment be configured as e.g. a back plate with e.g. a flow transition channel for transportation or feeding of the first medium from the first outlets to the second inlets therefor.

If further cooling of the second medium is required or desired by further feeding of the first medium through the first channel therefor, this is according to the present disclosure possible to achieve by configuring the first heat transferring surface of the plate with at least two protrusions forming continuous and closed ridges. The protrusions are arranged to divide said first heat transferring surface into the closed inner region and the outer region as defined above, whereby said inner region completely encloses the first inlet porthole for the first medium, the first outlet porthole for the first medium and the inlet porthole for the second medium and said outer region completely encloses the second inlet porthole for the first medium and the second outlet porthole for the first medium, but also into at least one closed intermediate region between said inner and outer regions, whereby said intermediate region completely encloses an additional inlet porthole for the first medium and an additional outlet porthole for the first medium.

By assembling a plurality of first and second plates of the above-mentioned latter configuration into a heat exchange arrangement, the protrusions on the first heat transferring surface of said plates are connected to each other to separate each first channel into the first and second flow paths and into at least one intermediate flow path for the first medium between the first and second flow paths. Each intermediate flow path between respective two plates of which the first heat transferring surface face each other, is configured in use to direct a flow of the first medium from an additional inlet to an additional outlet inside the at least one intermediate region. The additional inlet and outlet are both defined between the additional inlet portholes and outlet portholes for the first medium respectively, on the first and second plates.

BRIEF DESCRIPTION OF THE DRAWINGS

The above-mentioned and additional features of the present disclosure and the advantages therewith will be further described below by means of a non-limiting example with reference to the accompanying drawings. In the drawings.

It should be noted that the accompanying drawings are not necessarily drawn to scale and that the dimensions of some features of the present disclosure may have been exaggerated for the sake of clarity.

DETAILED DESCRIPTION

The present disclosure will in the following be exemplified by embodiments thereof. It should be realized however, that the embodiments are included to explain principles of the disclosure and not to limit the scope of the disclosure as defined by the appended claims.

As already mentioned, the present disclosure relates to a plate for a heat exchange arrangement as well as to a heat exchange arrangement which comprises a plurality of said plates.

The plate for the heat exchange arrangement is configured for the exchange of heat between a first and a second medium. The general concept of the plate according to the present disclosure can be read out from particularly FIG. 1, but also from FIG. 2.

Figure 1:
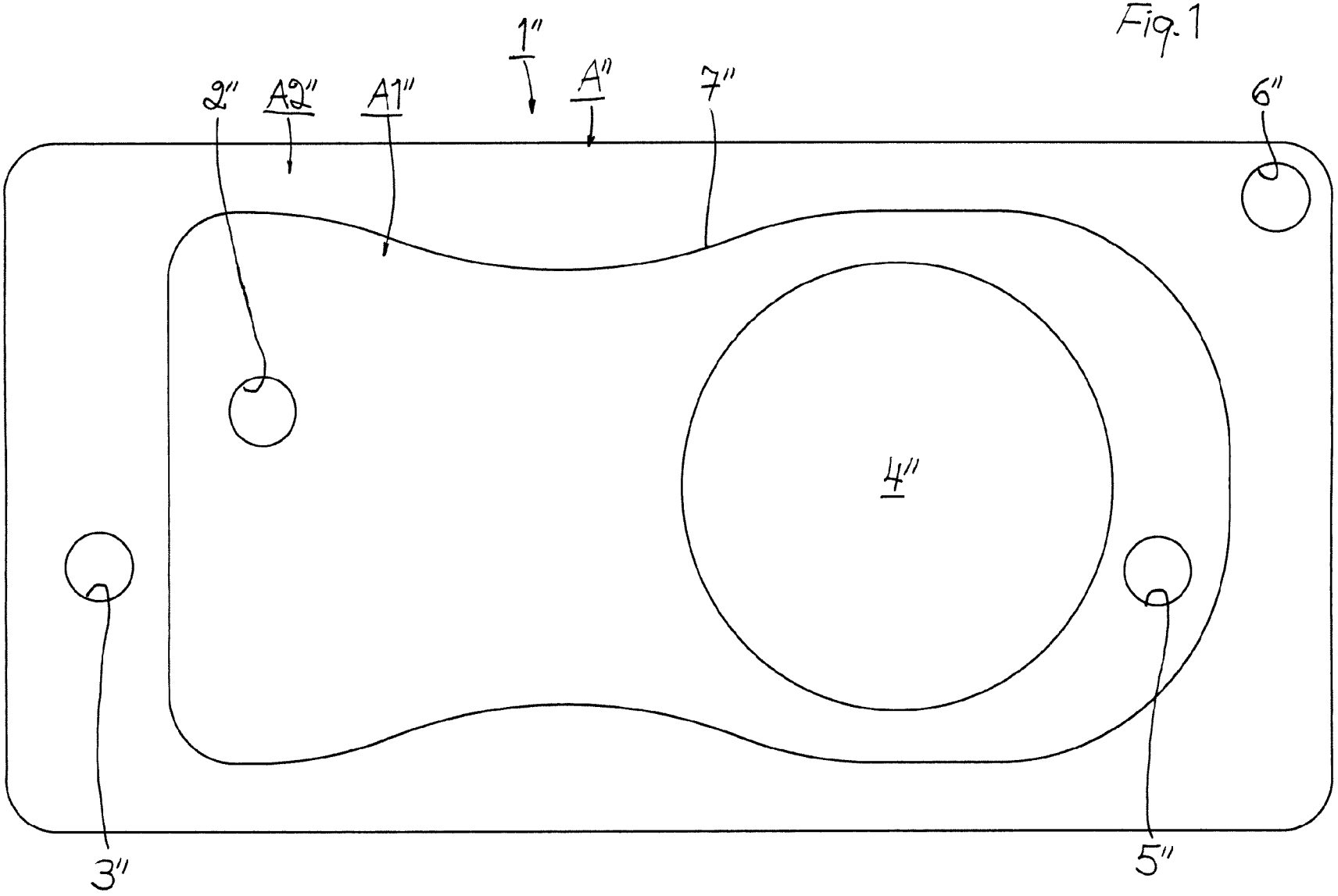
FIG. 1 is a very schematic plan view of a first heat transferring surface of a first general embodiment of a plate according to the disclosure for a heat exchange arrangement, said first heat transferring surface being arranged in use for contact with a first medium.

Accordingly, the plate 1" of FIG. 1 is as illustrated configured with a first heat transferring surface A" for the first medium, which here is the medium to be heated, e.g. water, and, on the opposite side of the plate not illustrated in FIG. 1, a second heat transferring surface for the second medium, e.g. a gas such as air, for heating the first medium. The plate 1" is provided with a first and a second inlet porthole 2" and 3" respectively, for the first medium, permitting inflow of said first medium to the first side A" of the plate, and an inlet porthole 4" for the second medium, permitting inflow of said second medium to the second side of the plate. The plate 1" is further provided with a first and a second outlet porthole 5" and 6" respectively, for the first medium, permitting outflow of said first medium from said first side A" of the plate. Finally, the first heat transferring surface A" of the plate 1" is configured with a protrusion 7" forming a continuous and closed ridge which is arranged to divide said heat transfer surface into a closed inner region A1" and an outer region A2". The inner region A1" completely encloses the first inlet porthole 2" for the first medium, the first outlet porthole 5" for the first medium and the inlet porthole 4" for the second medium. Consequently, the second inlet porthole 3" for the first medium and the second outlet porthole 6" for the first medium are both found on the outer region A2" of the first heat transferring surface A" of the plate 1". The protrusion 7" is configured to provide for as good as possible, preferably optimum heat exchange between the first and second media. It is possible however, to configure the protrusion 7" in other ways than illustrated, thereby dividing the first heat transferring surface A" of the plate 1" into otherwise configured inner and outer regions A1" and A2".

In the illustrated embodiment according to FIG. 1, the inlet porthole 4" for the second medium is located between the first inlet porthole 2" and the first outlet porthole 5" for the first medium for optimum cooling of the second medium.

Figure 2:
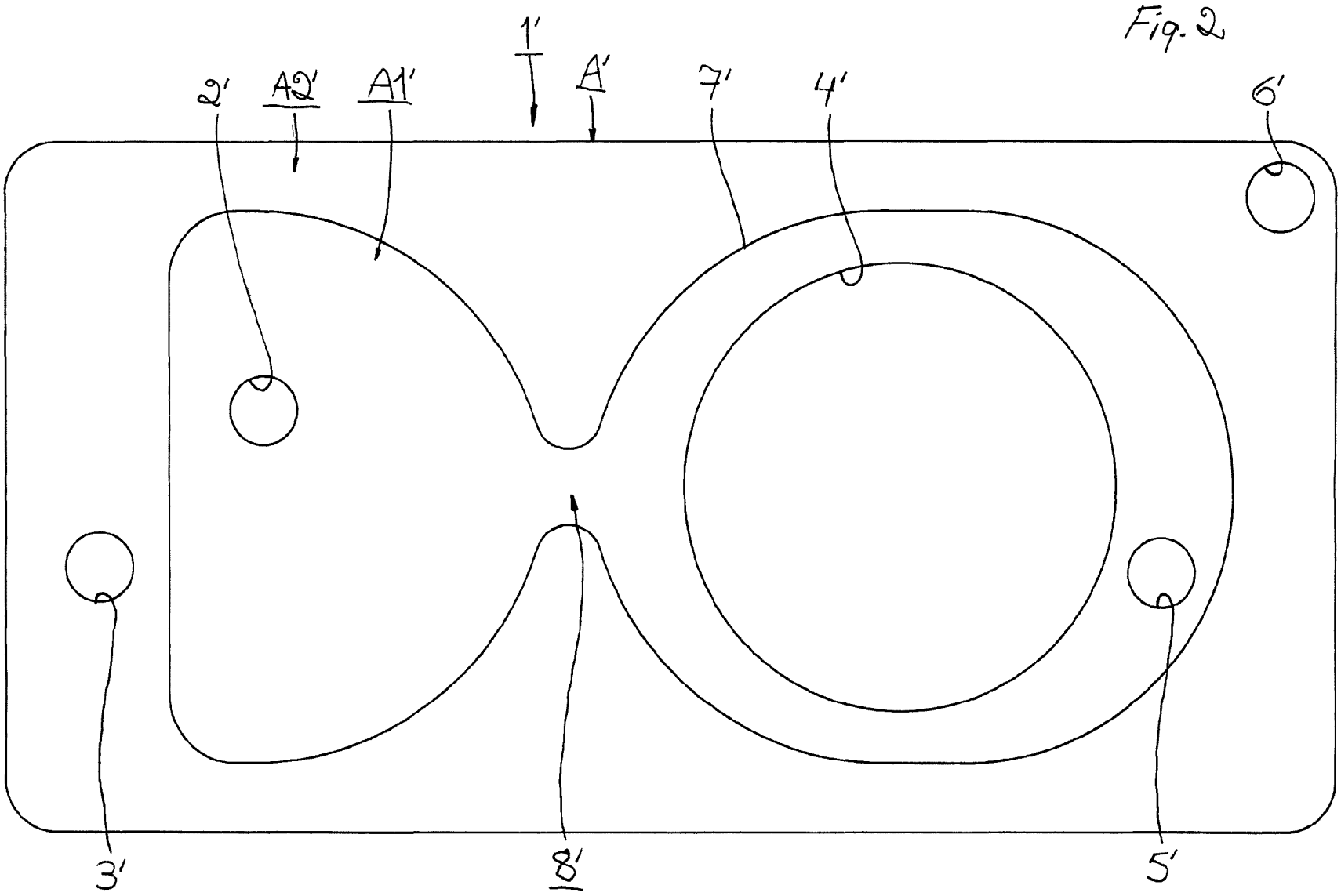
FIG. 2 is very schematic plan view of a first heat transferring surface of a second general embodiment of a plate according to the disclosure for a heat exchange arrangement said first heat transferring surface being arranged in use for contact with a first medium.
Figure 3:
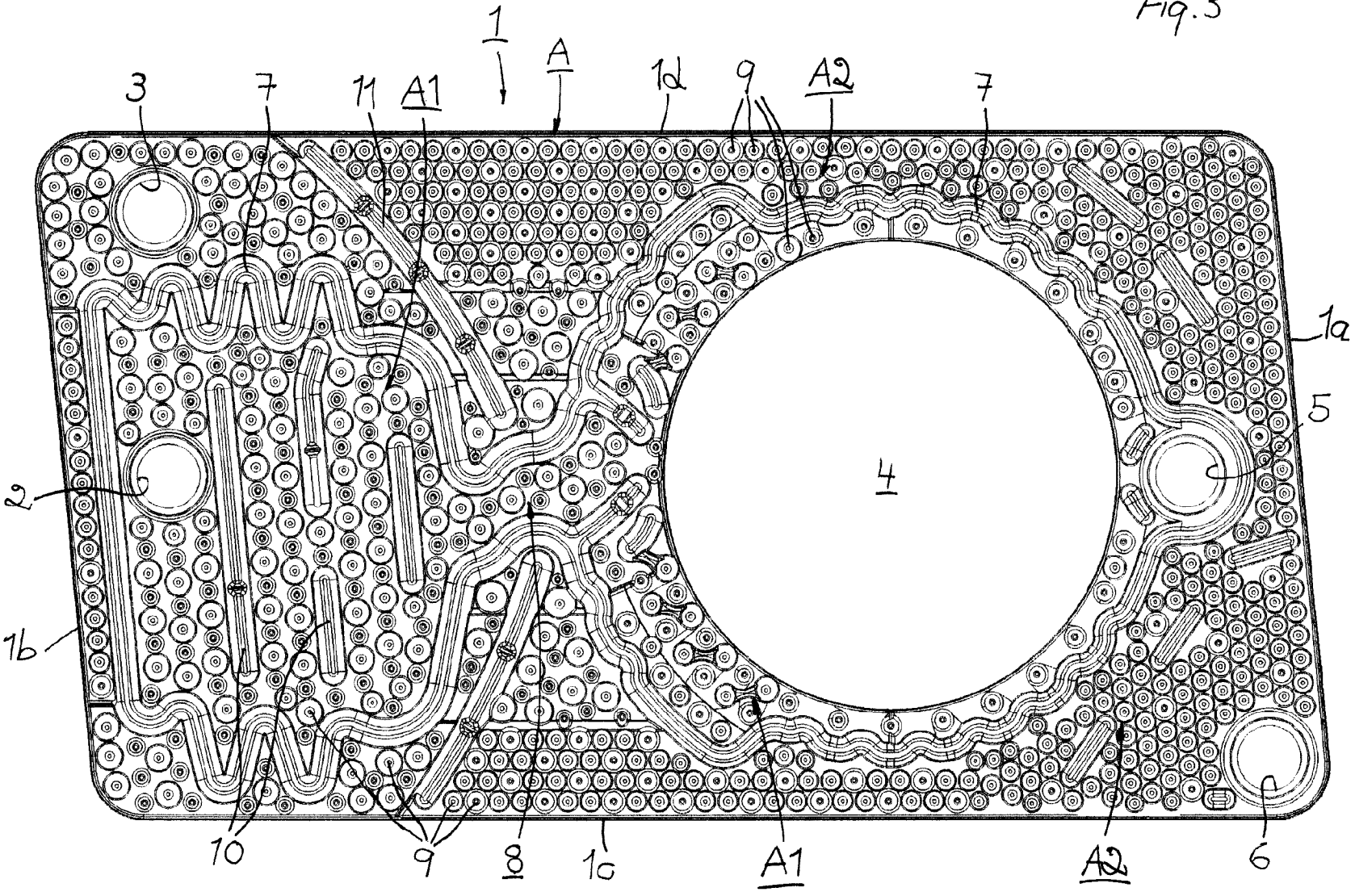
FIG. 3 is a plan view of a first heat transferring surface of an advantageous third embodiment of a first plate according to the disclosure for a heat exchange arrangement, said first heat transferring surface being arranged in use for contact with a first medium.
Figure 4:
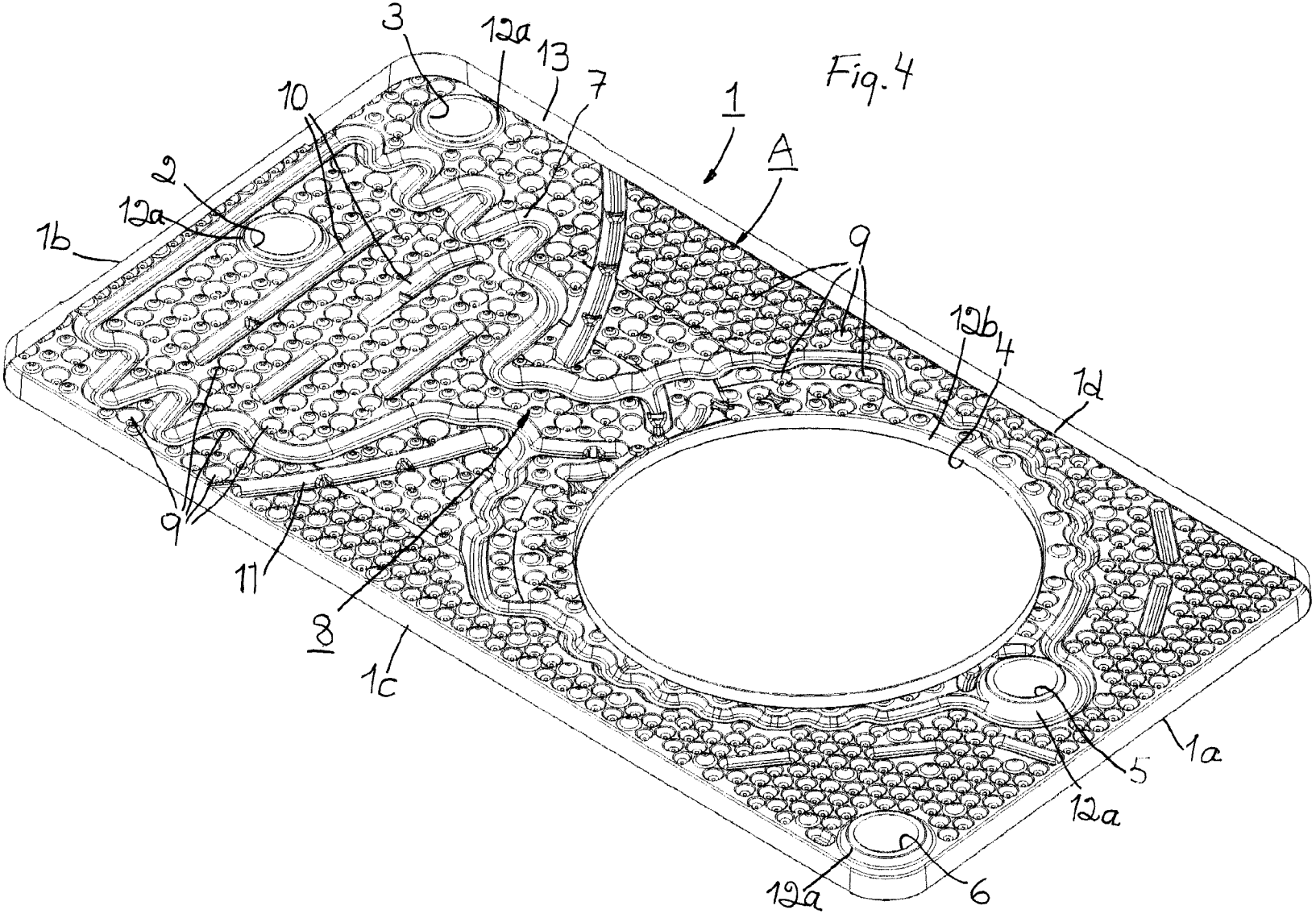
FIG. 4 is a perspective view of the first heat transferring surface of the plate according to FIG. 3.
Figure 5:
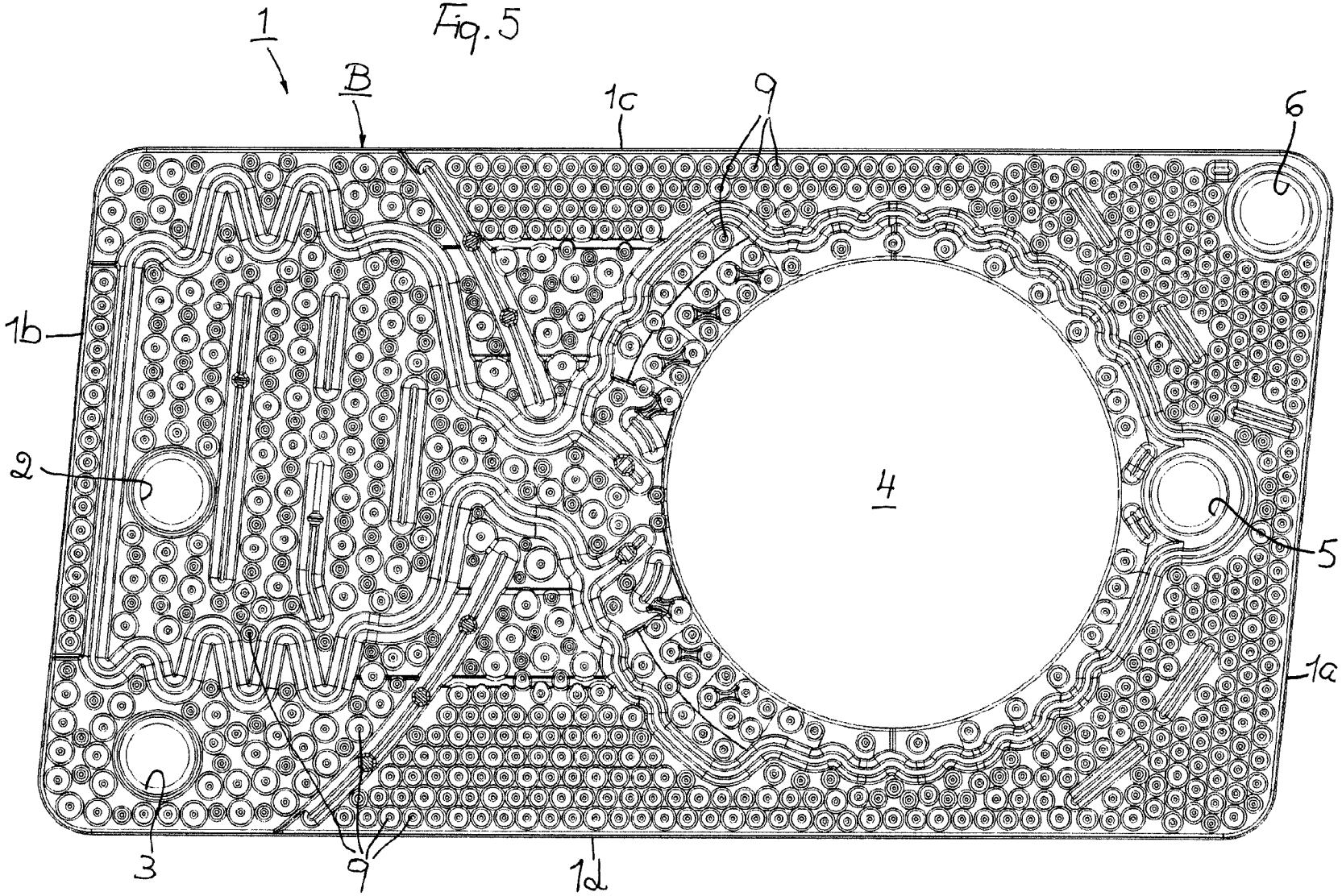
FIG. 5 is a plan view of a second heat transferring surface of the plate of FIG. 3, said second heat transferring surface being arranged in use for contact with a second medium.
Figure 6:
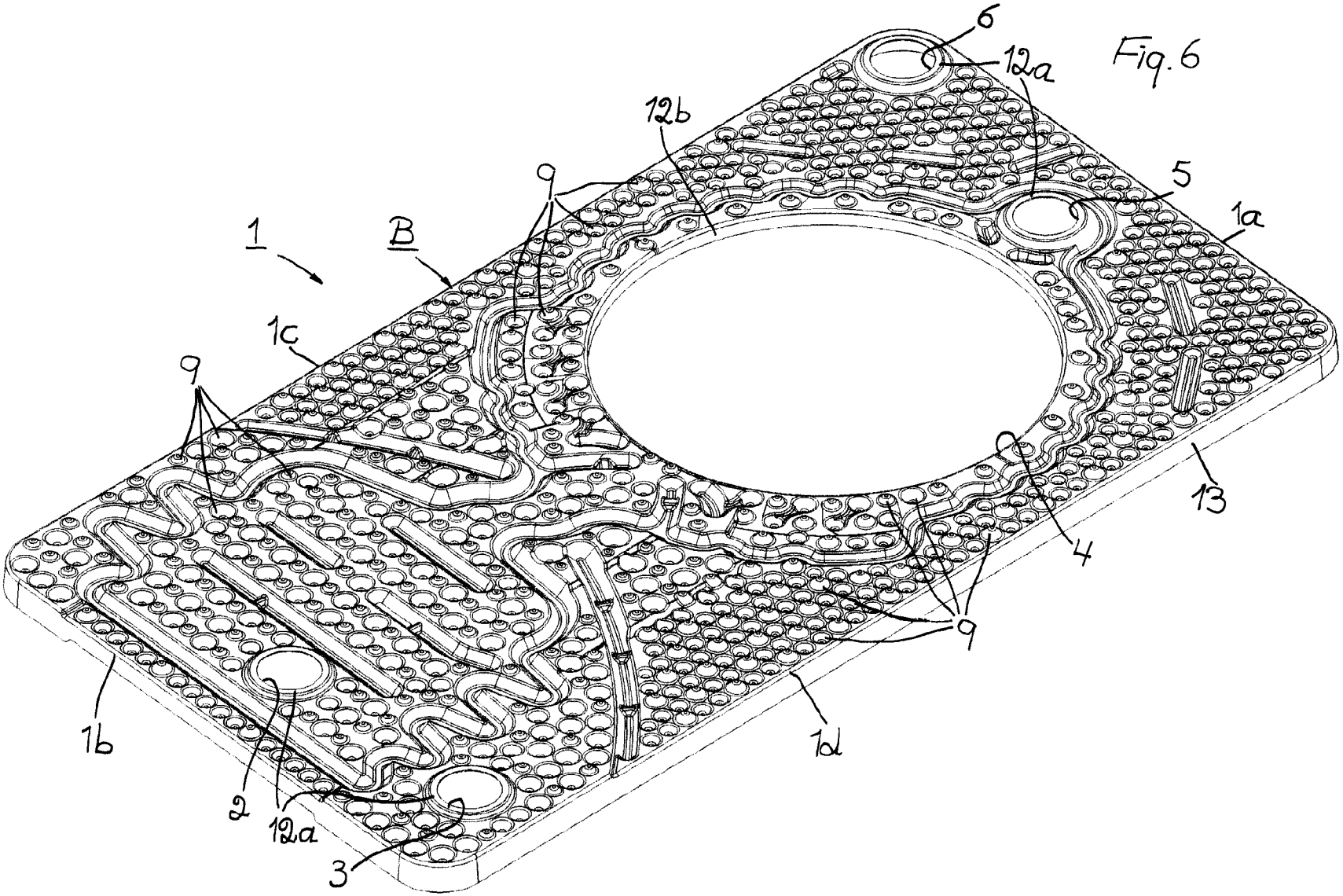
FIG. 6 is a perspective view of the second heat transferring surface of the plate according to FIG. 5.

In the embodiment of the plate according to the present disclosure illustrated in FIG. 2, the plate 1' is configured as defined above and is accordingly provided with first and second inlet port holes 2', 3' for the first medium, with an inlet porthole 4' for the second medium, with first and second outlet portholes 5', 6' for the first medium and with a protrusion 7' forming a continuous and closed ridge which is arranged to divide the first heat transferring surface A' surface into a closed inner region A1' and an outer region A2'.

In the illustrated embodiment according to FIG. 2, the inlet porthole 4' for the second medium is also located between the first inlet porthole 2' and the first outlet porthole 5' for the first medium for optimum cooling of the second medium and although the protrusion 7' as mentioned can be configured in any way to separate the inner region A1' and the outer region A2' from each other, the protrusion is as illustrated in FIG. 2 with advantage configured to define a restriction 8' between said first inlet porthole 2' for the first medium and said inlet porthole 4' for the second medium in order to be able to guide the flow of the first medium towards and around the inlet porthole for the second medium in an optimum manner.

FIG. 3-23 illustrate the plate according to the present disclosure in more detail. Thus, the plate 1 of particularly FIGS. 3-9 and the plate 1A of particularly FIG. 10-15 is each configured as defined above and is accordingly provided with first and second inlet port holes 2, 3 for the first medium, with an inlet porthole 4 for the second medium, with first and second outlet portholes 5, 6 for the first medium, whereby the inlet porthole 4 for the second medium is located between the first inlet porthole 2 and the first outlet porthole 5 for the first medium, and with a protrusion 7 forming a continuous and closed ridge on a first heat transferring surface A for the first medium of the plate. As illustrated in FIG. 3-23, the protrusion 7 forms a corresponding continuous and closed depression on a second heat transferring surface B for the second medium on the opposite side of the plate. The protrusion 7 is as in the embodiments of FIGS. 1 and 2 arranged to divide the first heat transferring surface A into one closed inner region A1 and an outer region A2 and forms a restriction 8 between said first inlet porthole 2 for the first medium and said inlet porthole 4 for the second medium as in the embodiment of FIG. 2 in order to be able to guide the flow of the first medium towards and around the inlet porthole for the second medium in an optimum manner.

As also illustrated in FIG. 3-23, the plate 1, 1A is further configured with a plurality of dimples 9 forming elevations and corresponding depressions on the first and second heat transferring surfaces A, B. The number, size and arrangement of the dimples 9 can vary.

The plate can be rectangular as illustrated in FIGS. 1 and 2, square, shaped as a rhombus or, as illustrated in FIGS. 3, 5, 10 and 12, shaped as a rhomboid, having four sides or edges 1*a*, 1*b*, 1*c* and 1*d*, i.e. two opposing parallel shorter sides or edges 1*a* and 1*b* and two opposing parallel longer sides or edges 1*c* and 1*d*, and having non-right corners. The inlet porthole 4 for the second medium and the first and second outlet portholes 5, 6 for the first medium are located in close proximity to one edge 1*a* of the plate 1 and the first and second inlet portholes 2, 3 for the first medium are located in close proximity to the opposite edge 1*b* of the plate, i.e. in the illustrated embodiment close to the opposing shorter sides or edges of the plate, or, in other words, the distance between said outlet and inlet portholes respectively, and said one side and said opposite side respectively, is insignificant in relation to the distance between said outlet and inlet portholes. It is within the scope of the disclosure possible to give the plate 1 any other quadrilateral configuration.

As illustrated in FIG. 3-23, the first outlet porthole 5 and the first inlet porthole 2 for the first medium are located in close proximity to the centre portion of said one edge 1*a* and said opposite edge 1*b* respectively, of the plate 1, 1A. Also, the second outlet porthole 6 and the second inlet porthole 3 for the first medium are located substantially diagonally opposite each other in close proximity to said one edge 1*a* and said opposite edge 1*b* respectively, of the plate 1, 1A. In an advantageous embodiment, the second outlet porthole 6 is located in close proximity to the corner defined between edges 1*a* and 1*c* of the plate 1, 1A and the second inlet porthole 3 in close proximity to the corner defined between edges 1*b* and 1*d* of the plate, as illustrated in the drawings.

As illustrated in FIG. 3-23, the inner region A1 and the outer region A2 on the first heat transferring surface A of the plate 1, 1A are configured with broken longitudinal protrusions 10 and 11 respectively, for controlling the flow of the first medium through said regions and guiding, in use, the flow of the first medium from the respective inlet to the respective outlet in said inner and outer regions such that optimum cooling of the second medium is achieved and thereby, optimum heating of said first medium. Depressions corresponding to the broken longitudinal protrusions 10, 11 are found on the second heat transferring surface B of the plate 1, 1A. The broken longitudinal protrusions 10, 11 can be configured in any other suitable way than illustrated in order to provide for the best possible control and guidance of the flow of the first medium.

Figure 7:
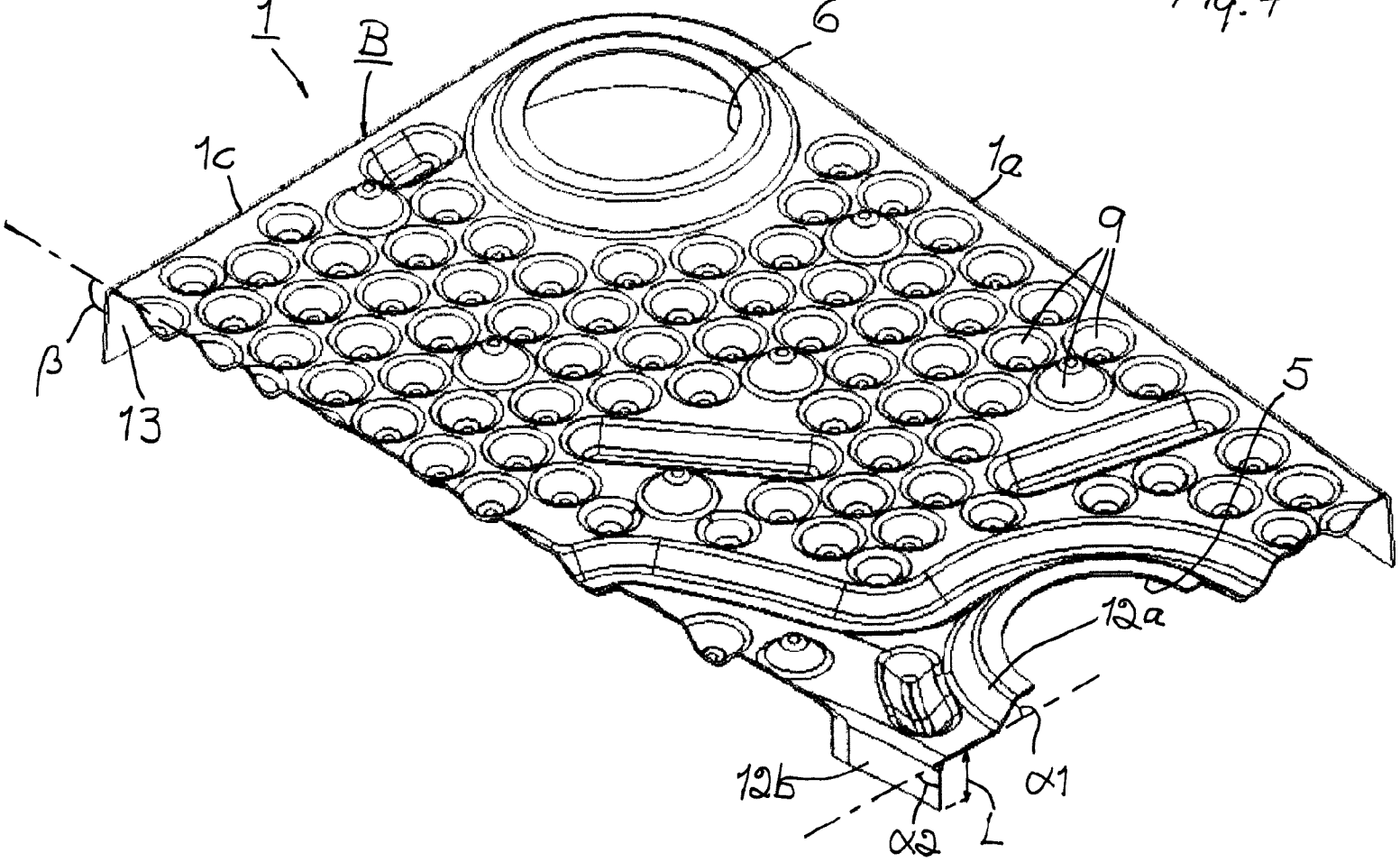
FIG. 7 is a perspective view of a small portion of said second heat transferring surface of the plate according to FIGS. 5 and 6.
Figure 8:
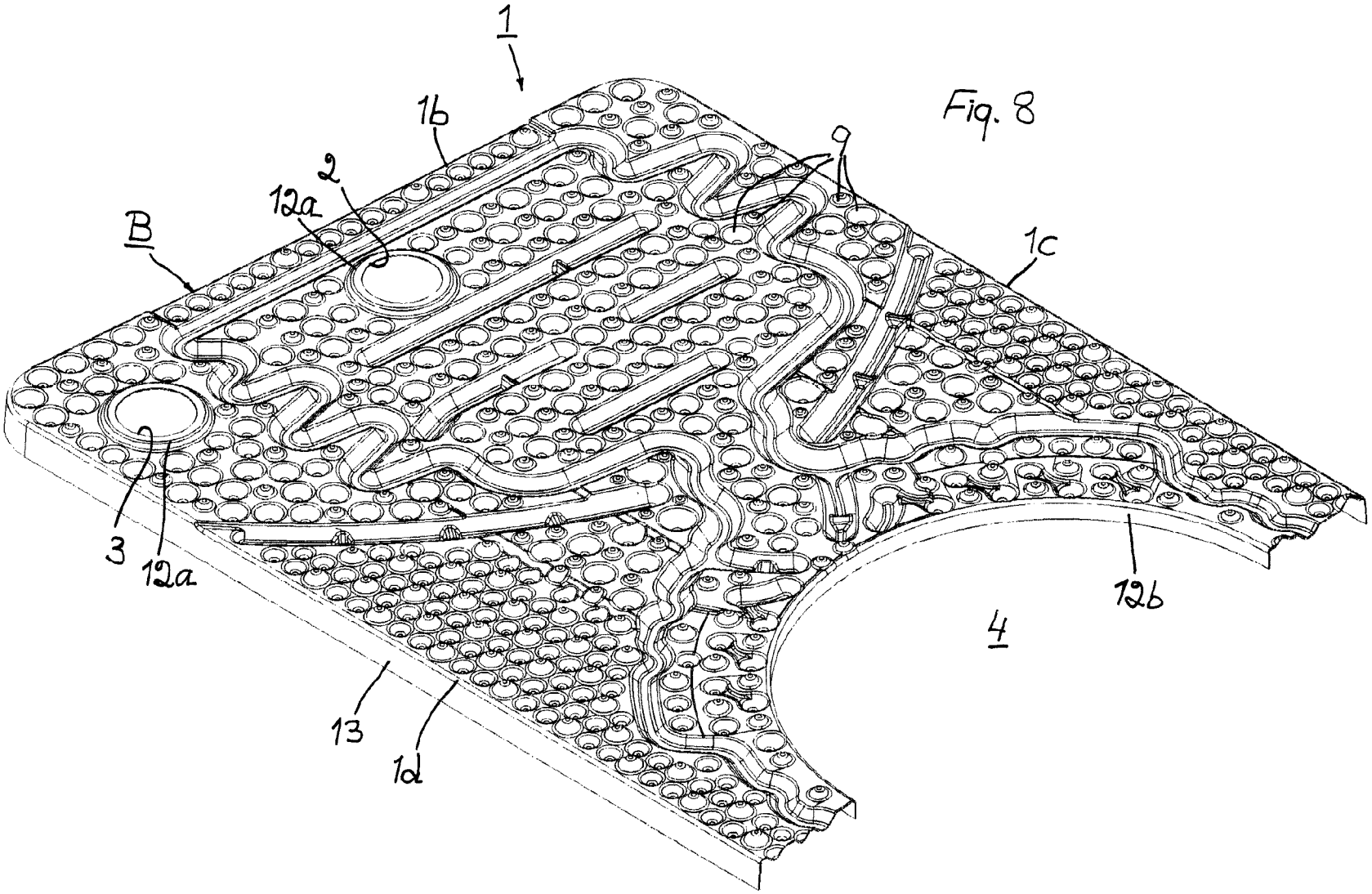
FIG. 8 is a perspective view of another portion of said second heat transferring surface of the plate according to FIGS. 5 and 6.
Figure 9:
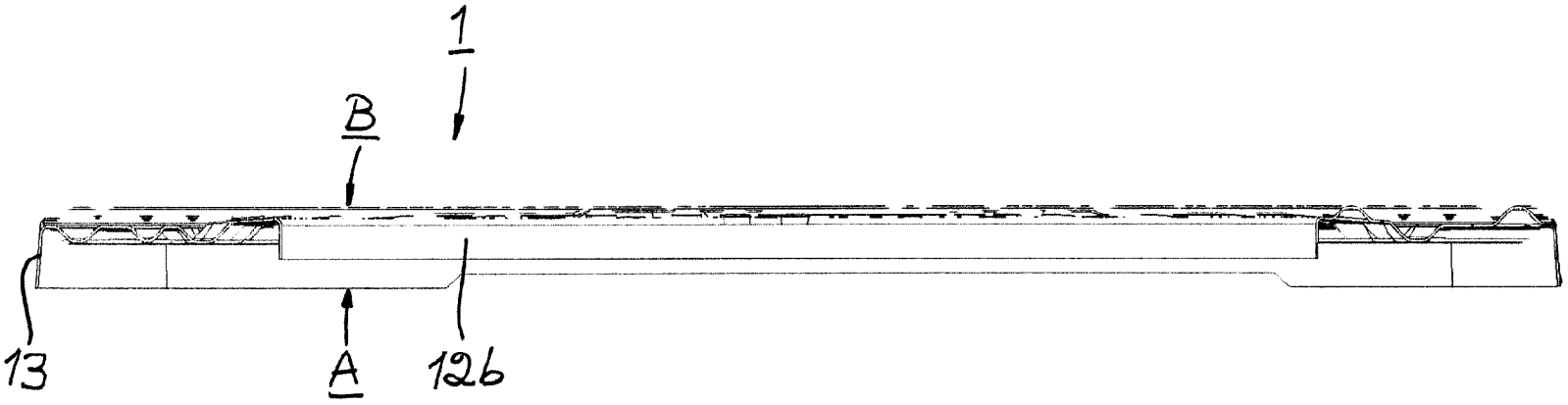
FIG. 9 is a side view of the plate portion according to FIG. 8.
Figure 10:
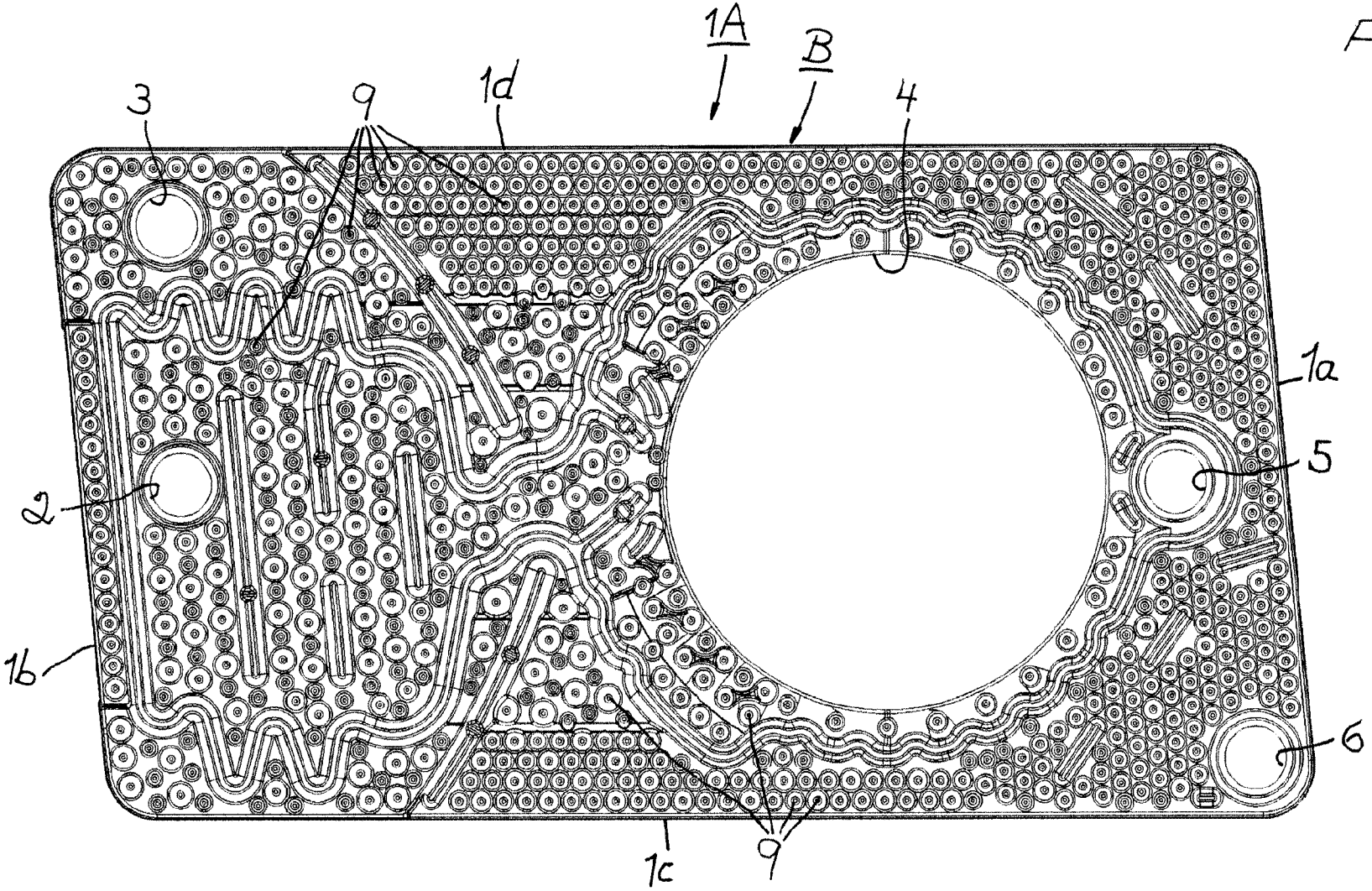
FIG. 10 is a plan view of a (second) heat transferring surface of an advantageous embodiment of a second plate according to the disclosure for a heat exchange arrangement, said (second) heat transferring surface being arranged in use for contact with the second medium.
Figure 11:
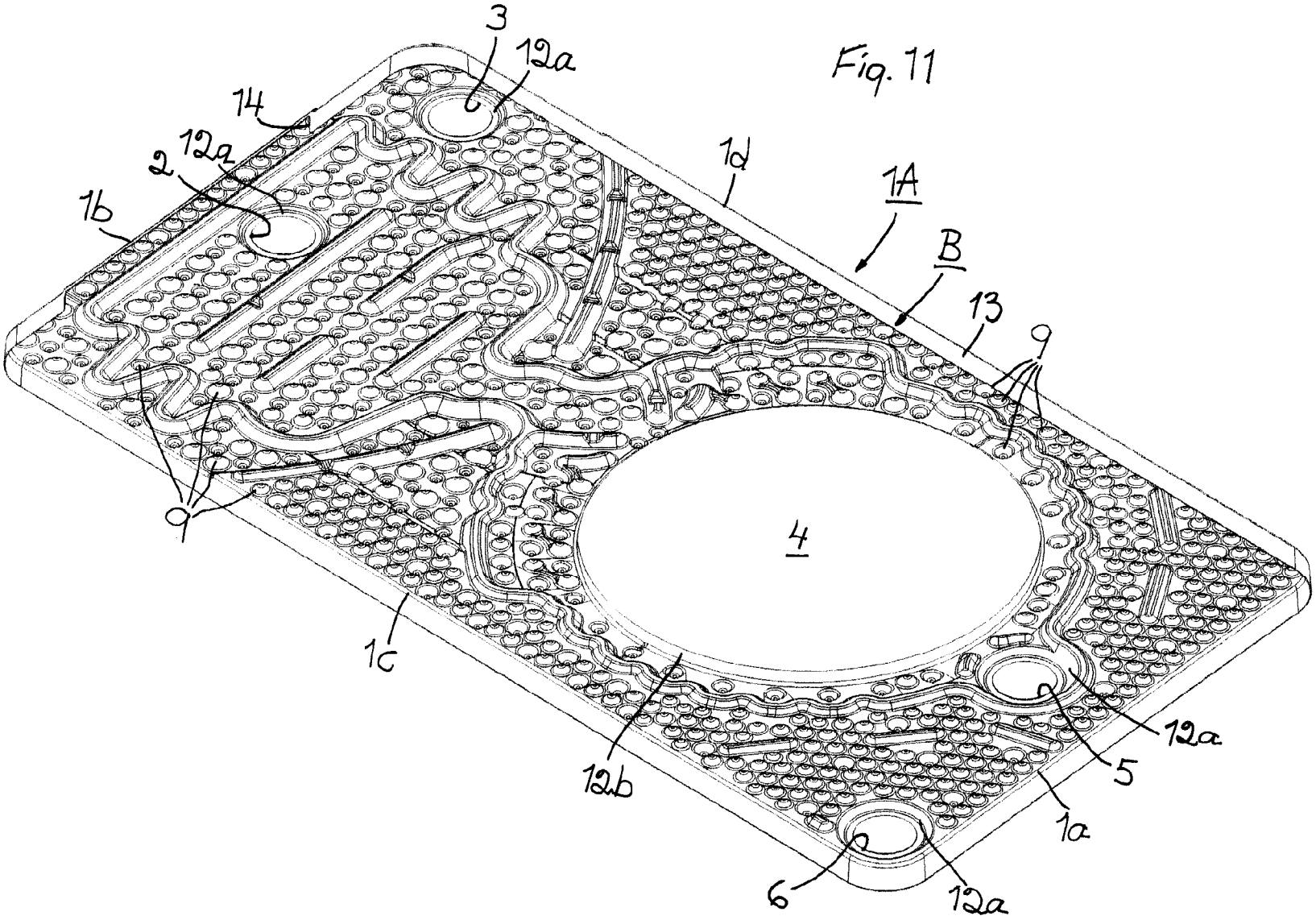
FIG. 11 is a perspective view of said (second) heat transferring surface of the second plate according to FIG. 10.
Figure 12:
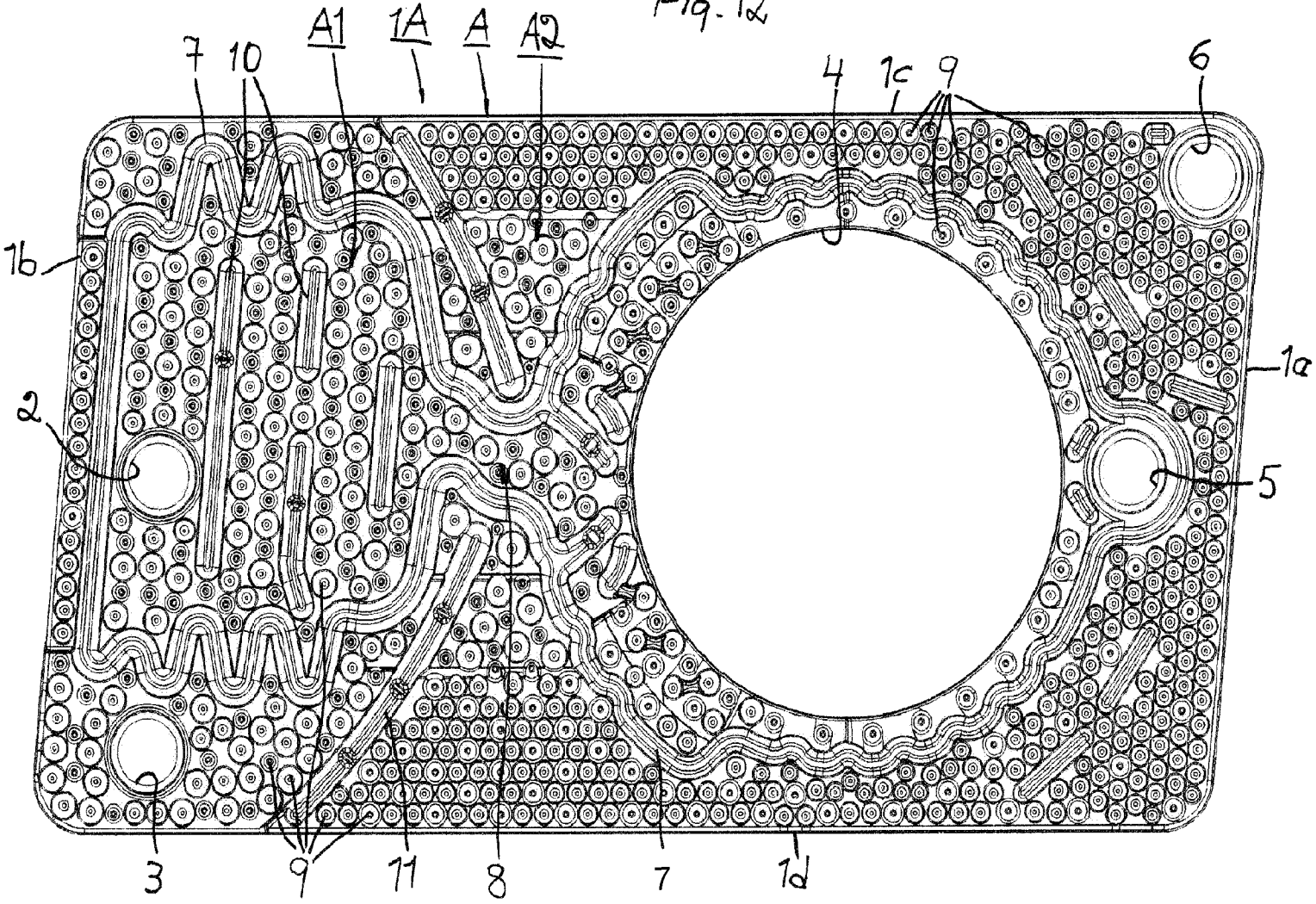
FIG. 12 is a plan view of another (first) heat transferring surface of the second plate of FIG. 10, said other (first) heat transferring surface being arranged in use for contact with the first medium.
Figure 13:
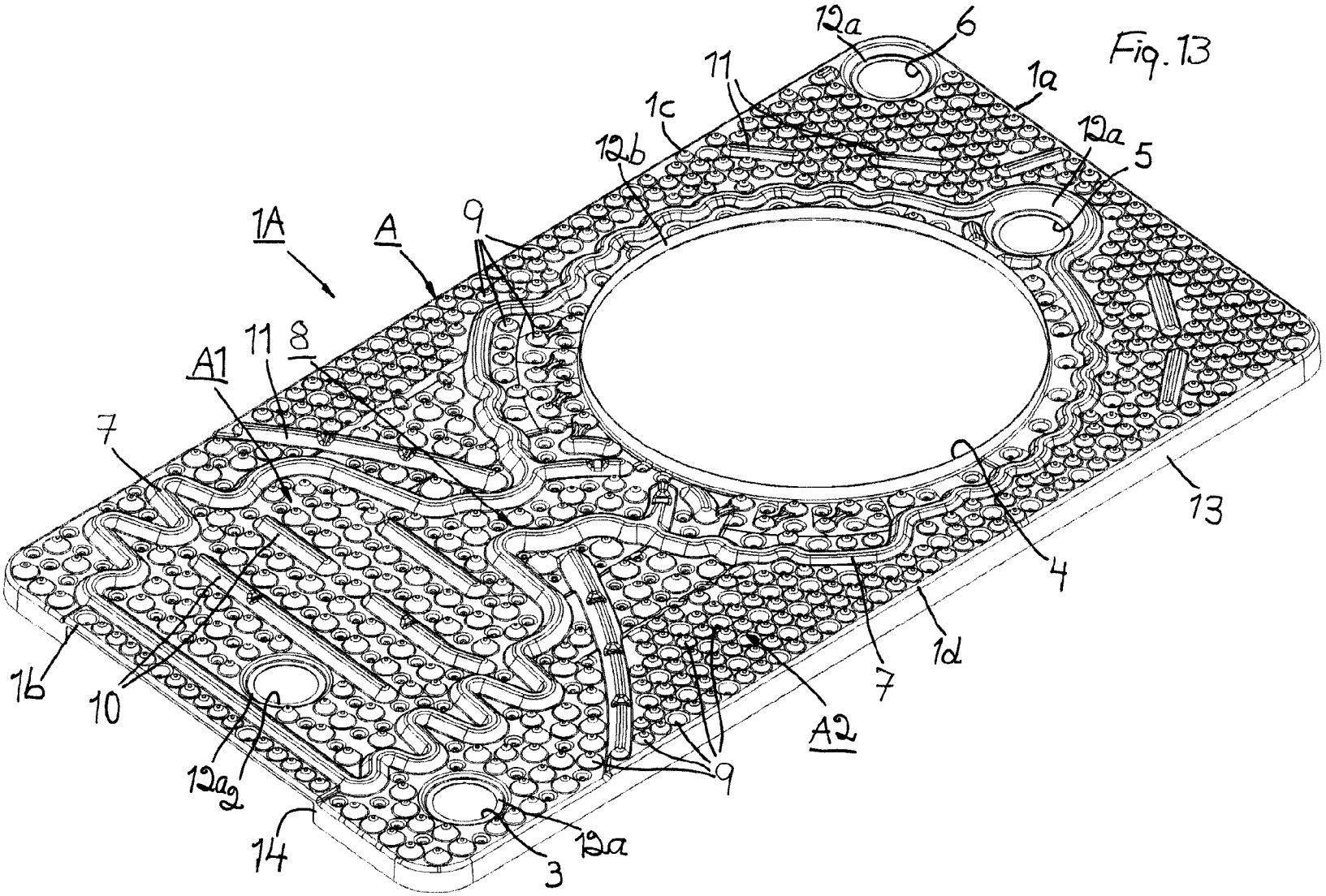
FIG. 13 is a perspective view of said (first) heat transferring surface of the second plate according to FIG. 12.
Figure 14:
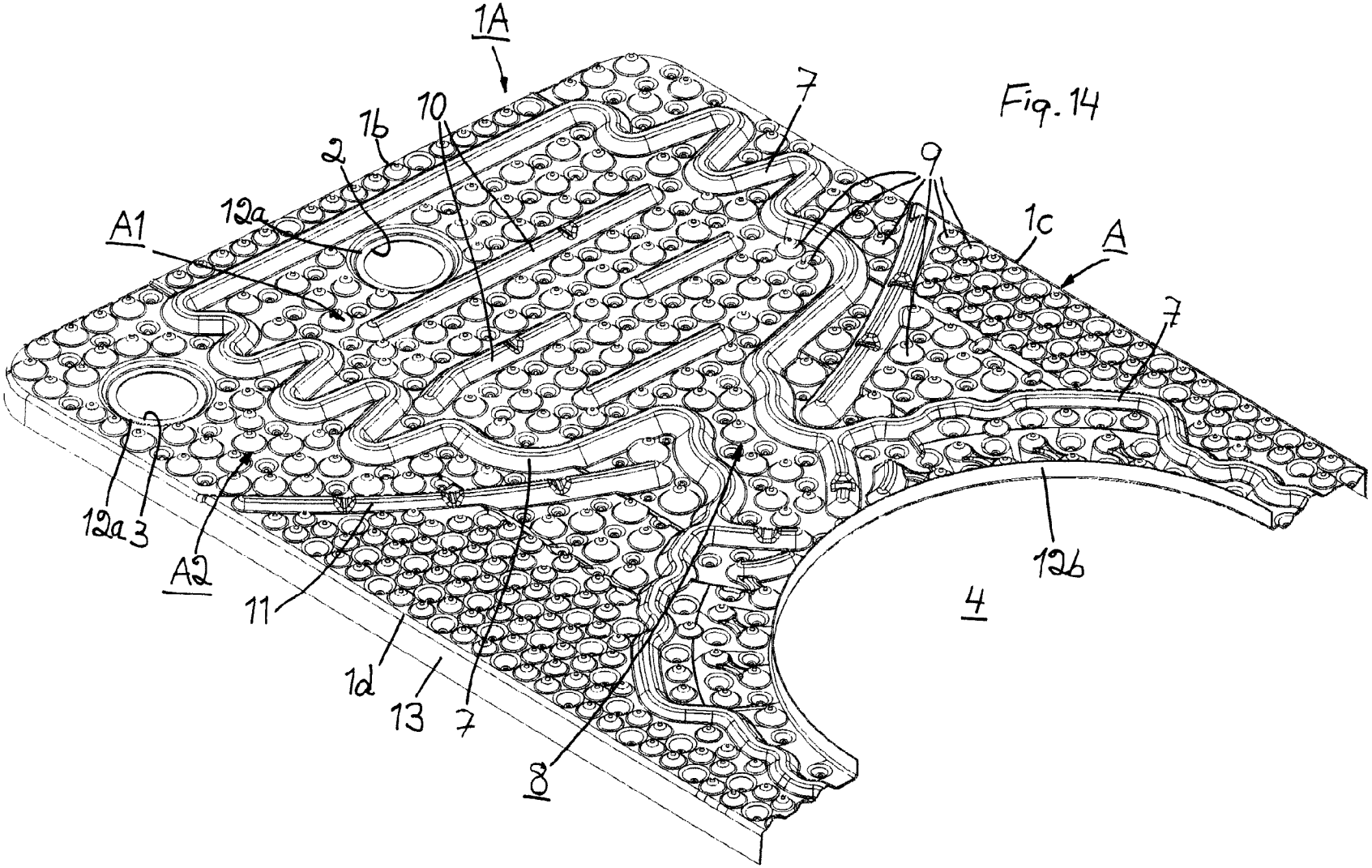
FIG. 14 is a perspective view of a portion of said (first) heat transferring surface of the second plate according to FIGS. 12 and 13.
Figure 15:
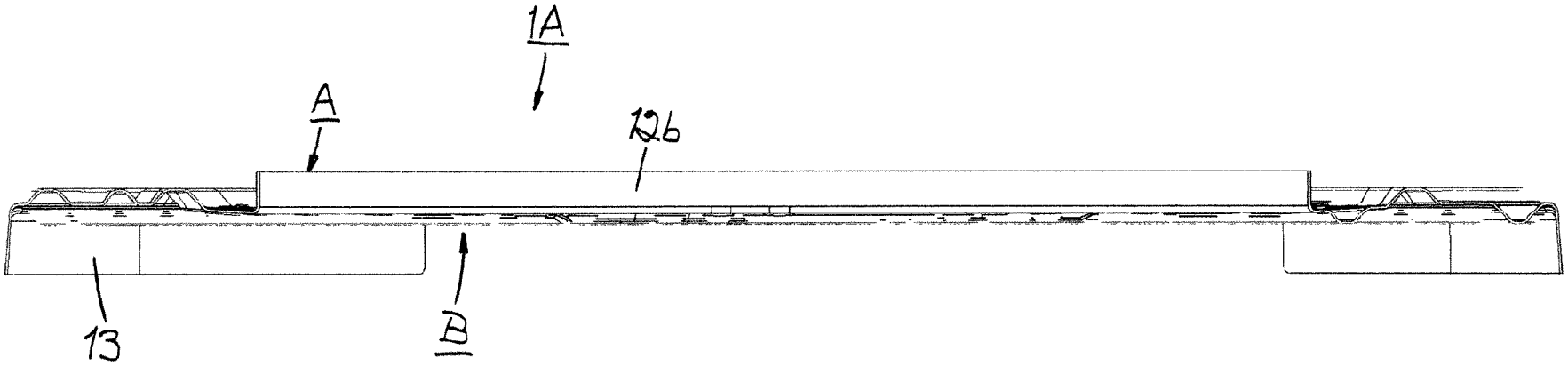
FIG. 15 is a side view of the plate portion according to FIG. 14.

The periphery of each of the first and second inlet portholes 2, 3 and the first and second outlet portholes 5, 6 for the first medium is folded at an angle $\alpha 1$ (see FIG. 7). This angle $\alpha 1$ may be more than e.g. 75 degrees with respect to the second heat transferring surface B of the plate 1, 1A. However, the angle $\alpha 1$ may alternatively be less than 75 degrees and/or the folds 12*a* can be configured in other ways if desired. Furthermore, it is within the scope of the disclosure that the configurations as well as the angles of the portholes 2, 3, 5, 6 in a plate 1, 1A may vary. To minimize thermal stresses, the periphery of particularly the inlet porthole 4 for the second medium however, is with advantage folded at an angle $\alpha 2$ (see FIG. 7) of e.g. more than 75 degrees with respect to the first heat transferring surface A of the plate 1, 1A, even if the angle $\alpha 2$ also may be less than 75 degrees and/or the fold 12*b* also can be configured in other ways if desired. In any case it is important to see to that in use, a secure sealing is obtained towards the heat transferring surface A or B in question such that the first and the second media are prevented from penetrating into that heat transferring surface A or B which is intended for the other medium. The length L of the fold 12*b* of the inlet porthole 4 for the second medium is less than twice the height of the elevations formed by the dimples 9. The folds 12*a* of the first and second inlet portholes 2, 3 and the first and second outlet portholes 5, 6 for the first medium may have the same length.

Each of the above-mentioned plates 1"; 1'; 1, 1A according to the present disclosure as well as the plates 1'"; 1"" described hereinafter is configured to permit assembly with additional plates for the heat exchange arrangement, such that the first heat transferring side A of the plate together with a first heat transferring side A of an adjacent plate defines a first channel or through-flow duct for the first medium and such that the second heat transferring side B of the plate together with a second heat transferring side B of another adjacent plate defines a second channel or through-flow duct for the second medium.

Figure 16:
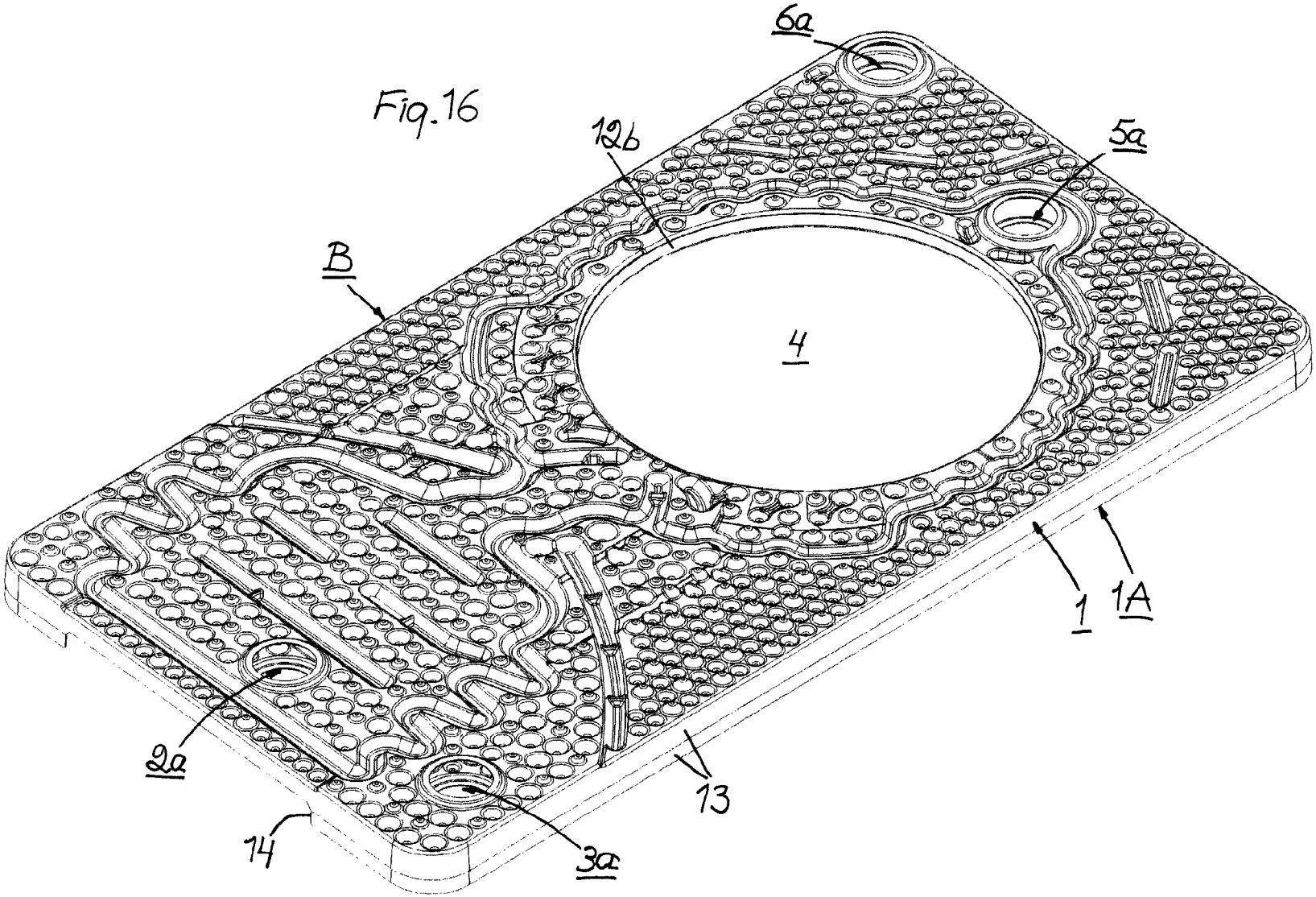
FIG. 16 is a perspective view of said second heat transferring surface of said first plate after assembly thereof with a second plate.
Figure 17:
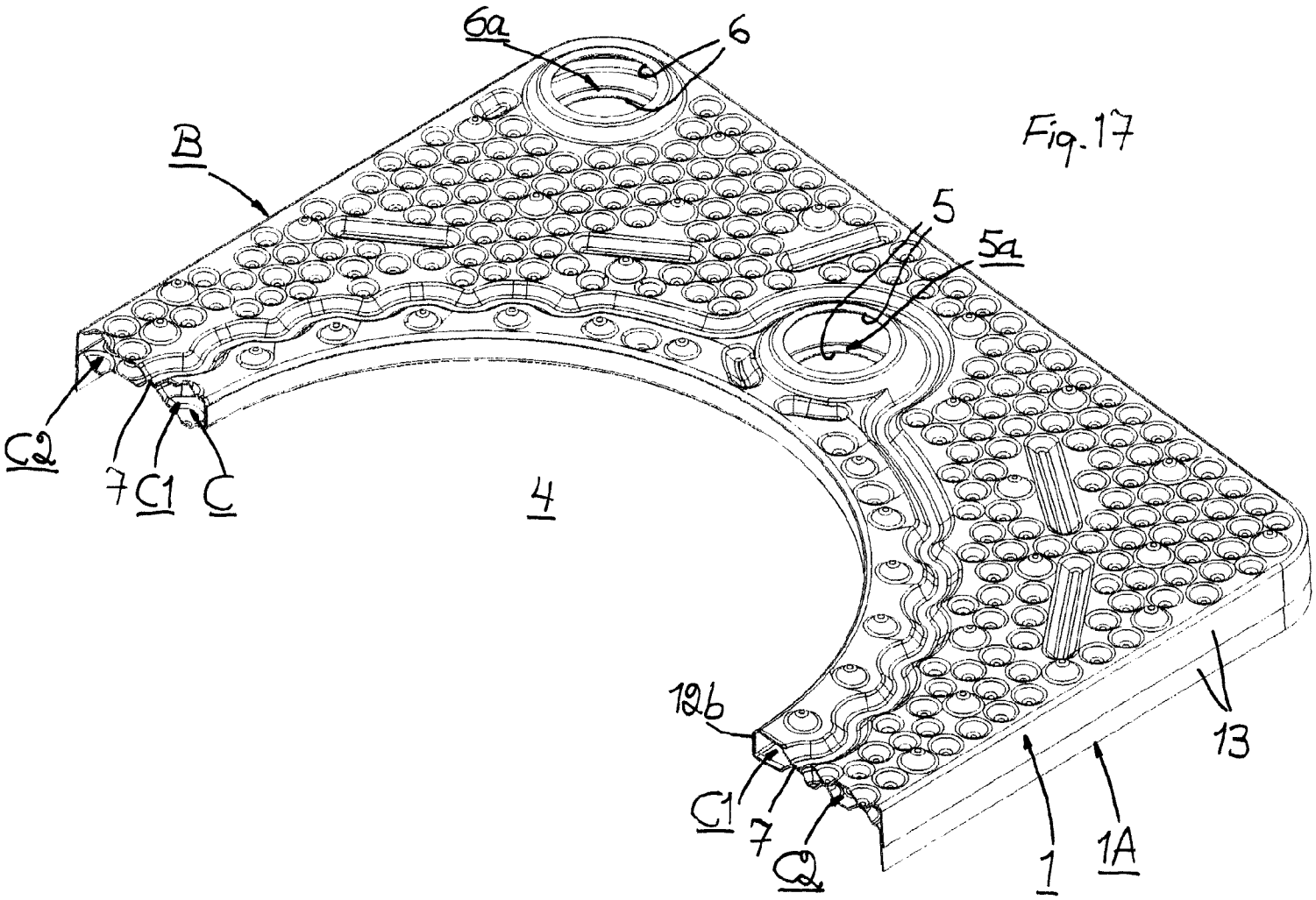
FIG. 17 is a perspective view of a portion of the plates according to FIG. 16.
Figure 18:
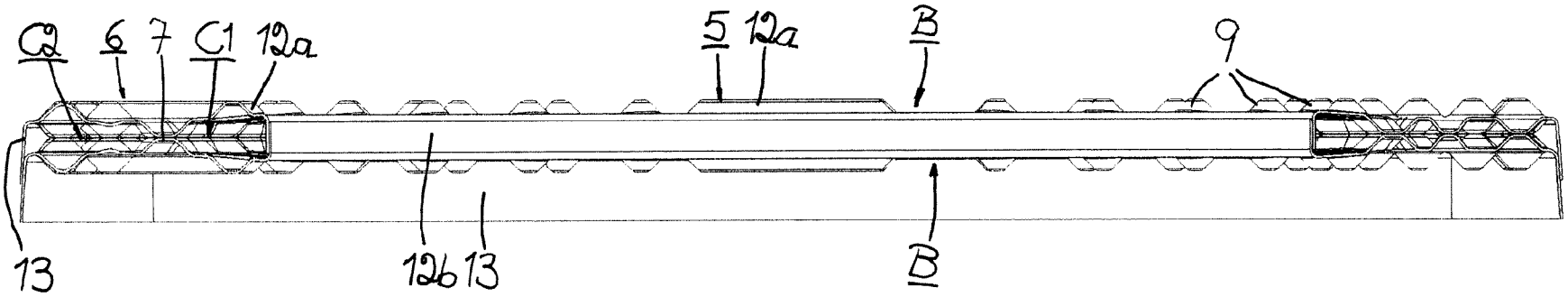
FIG. 18 is a side view of the plate portions according to FIG. 17.
Figure 19:
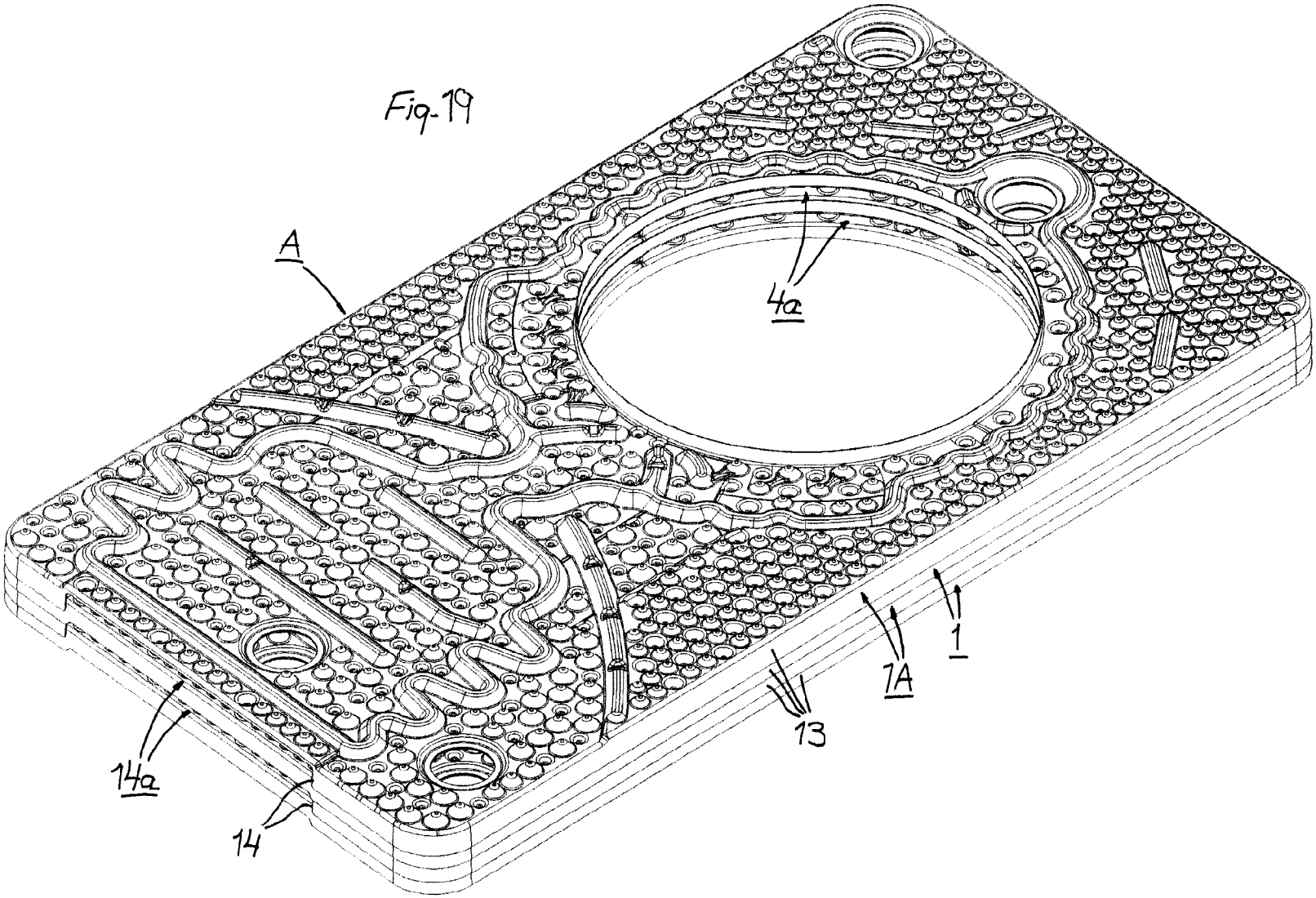
FIG. 19 is a perspective view of said (first) heat transferring surface of said second plate after assembly thereof with one other second plate and two first plates in an alternately stacked arrangement.
Figure 20:
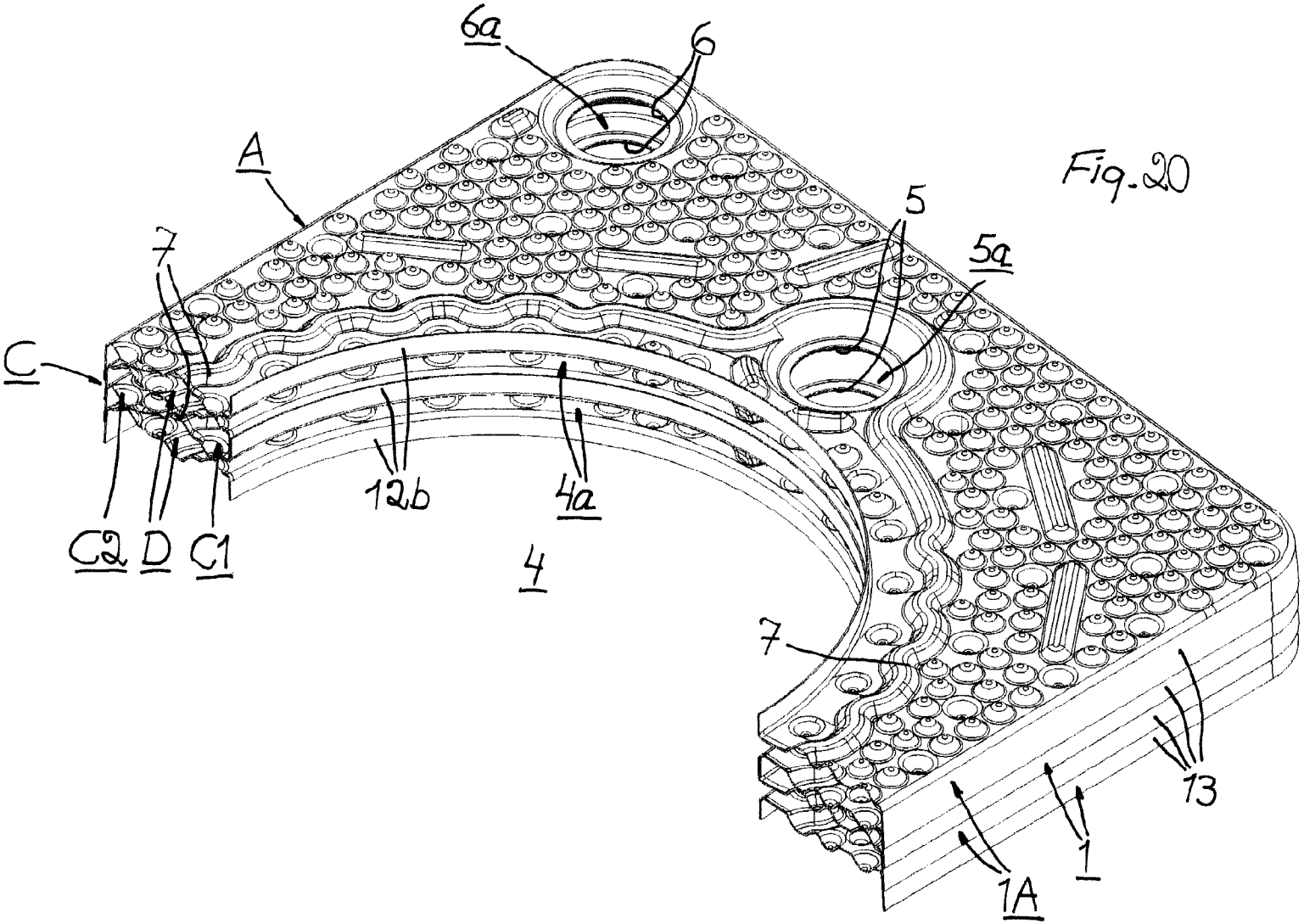
FIG. 20 is a perspective view of a portion of the plates according to FIG. 19.
Figure 21:
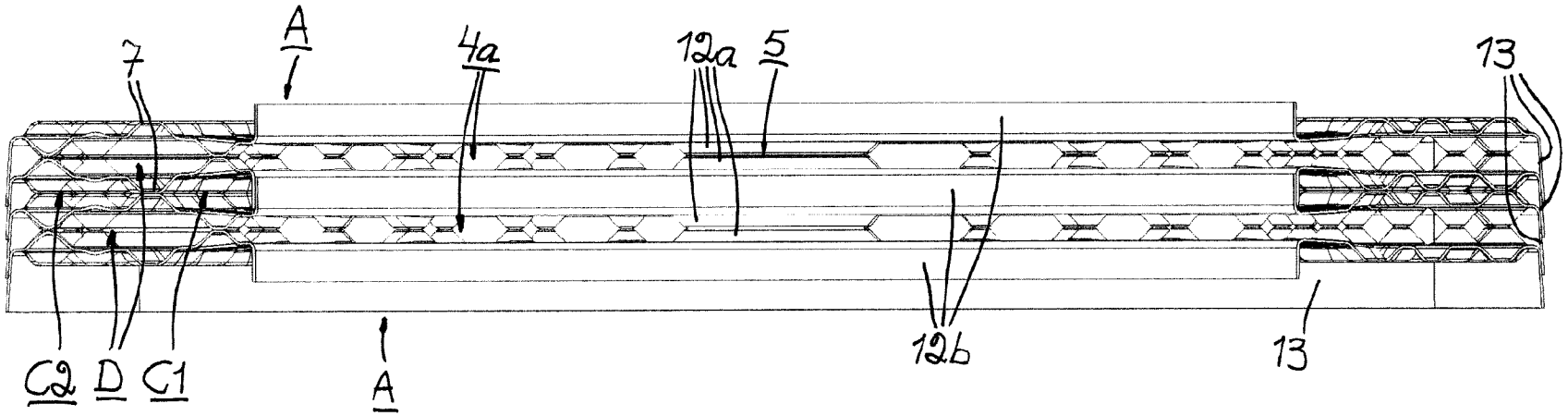
FIG. 21 is a side view of the plate portions according to FIG. 20.

Since the embodiment of the plate 1, 1A described above and illustrated in FIG. 3-23 is not symmetric (which is true also for the plate 1"; 1' of FIGS. 1 and 2 respectively, and for the plate 1'"; 1"" of FIGS. 24 and 25 respectively), the heat exchange arrangement may as illustrated comprise a plurality of first plates 1 according to FIGS. 3-9 and a plurality of second plates 1A according to FIG. 10-15. The second plates 1A are mirror copies of the first plates 1 and said first and said second plates are alternately stacked to form a repetitive sequence of a first channel C for the first medium and a second channel D for the second medium. Each first channel C is defined by the first heat transferring surface A of the first plate 1 and the first heat transferring surface A of the second plate 1A and each second channel D is defined by the second heat transferring surface B of the first plate 1 and the second heat transferring surface B of the second plate 1A. Two plates which are stacked on top of each other are illustrated in FIGS. 16-18 and four plates which are stacked on top of each other are illustrated in FIGS. 19-21. A preferred number of plates 1, 1A is for the intended purpose e.g. 20, but the number of plates may be less or more than 20.

It should be noted however, that it is within the scope of the present disclosure that the plate 1 alternatively can be configured to be symmetric. Thereby, the plate 1 and the plate 1A will be identical.

After assembly, the heat exchange arrangement can be located in connection to a burning chamber with at least one burner in a heating device.

The first and the second inlet portholes 2, 3 for the first medium on the first and the second plates 1, 1A in the stack of plates define between them first and second inlets 2*a* and 3*a* respectively, for the first medium. The first and the second outlet portholes 5, 6 for the first medium on the first and the second plates 1, 1A in the stack of plates define between them first and second outlets 5*a* and 6*a* respectively, for the first medium. The inlet portholes 4 for the second medium on the first and the second plates 1, 1A in the stack of plates define between them inlets 4*a* for the second medium.

For optimum heating of the first medium and yet, optimum cooling of the second medium such that the plates 1, 1A are not subjected to excessive thermal stresses which might affect the plates negatively and facilitate the origin of leakage when used in a heat exchange arrangement, a particularly important feature of the heat exchange arrangement of the present disclosure is that the protrusions 7 on the first heat transferring surfaces A of the first and the second plates 1, 1A are connected to each other to separate each first channel C into a first and a second flow path C1 and C2 for the first medium such that each first flow path C1 is configured in use to direct a flow of the first medium from the first inlet 2*a* for the first medium to the first outlet 5*a* for the first medium inside the inner region A1 and each second flow path C2 is configured in use to direct the flow of the first medium from the second inlet 3*a* to the second outlet 6*a* in the outer region A2. Thanks to the restriction 8 of the protrusions 7, the flow of the first medium through the flow paths C1 therefor is directed more directly towards and around the inlets 4*a* for the second medium for more effective cooling of said second medium.

Thanks to the flow of the first medium first through the first flow path C1 and then through the second flow path C2 of each first channel C, it is now possible to subject the second medium to repeated cooling, i.e. cooling in two steps, first where the second medium has its highest temperature of about 1500° C., namely at the inlets 4*a* for said second medium, for cooling to about 900° C. in the inner regions A1 which also surround said inlets and then secondly in the outer regions A2 in which the second medium is cooled from about 900° C. to about 150° C. At the same time, the first medium is heated by the second medium from about 20° C. to about 40° C. during the flow of said first medium through the first flow paths C1 and then from about 40° C. to about 60° C. during the flow of said first medium through the second flow paths C2.

Through the restriction 8 defined by said protrusions 7, the flow of the first medium inside the inner regions A1 is guided towards the inlets 4*a* for the second medium for most effective cooling of said second medium where the temperature thereof is at its highest.

Figure 22:
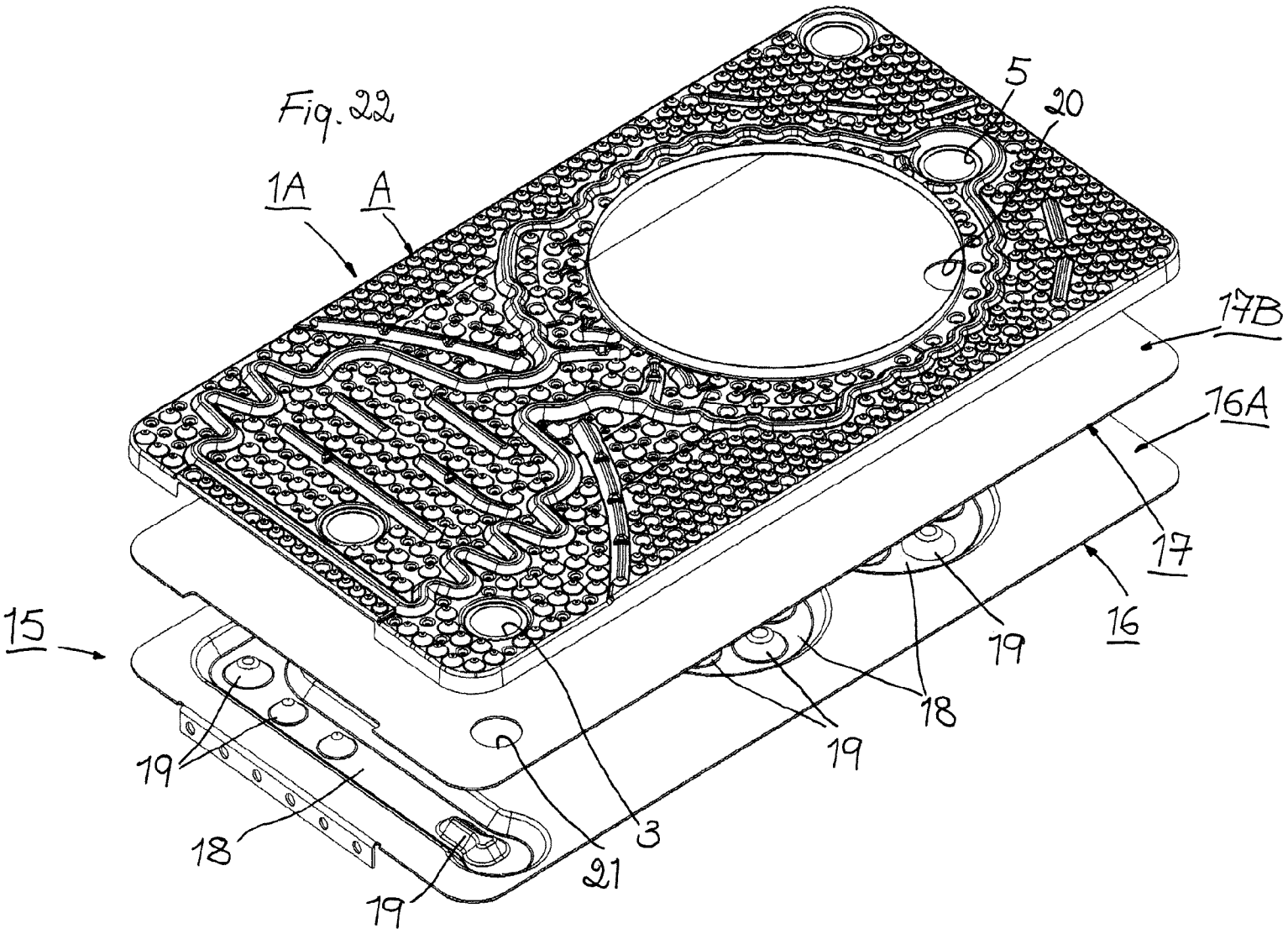
FIG. 22 is an exploded perspective view illustrating the (first) heat transferring surface of a second plate for a heat exchange arrangement as well as an end plate and an embodiment of a flow transition means in the form of a back plate from one side thereof.
Figure 23:
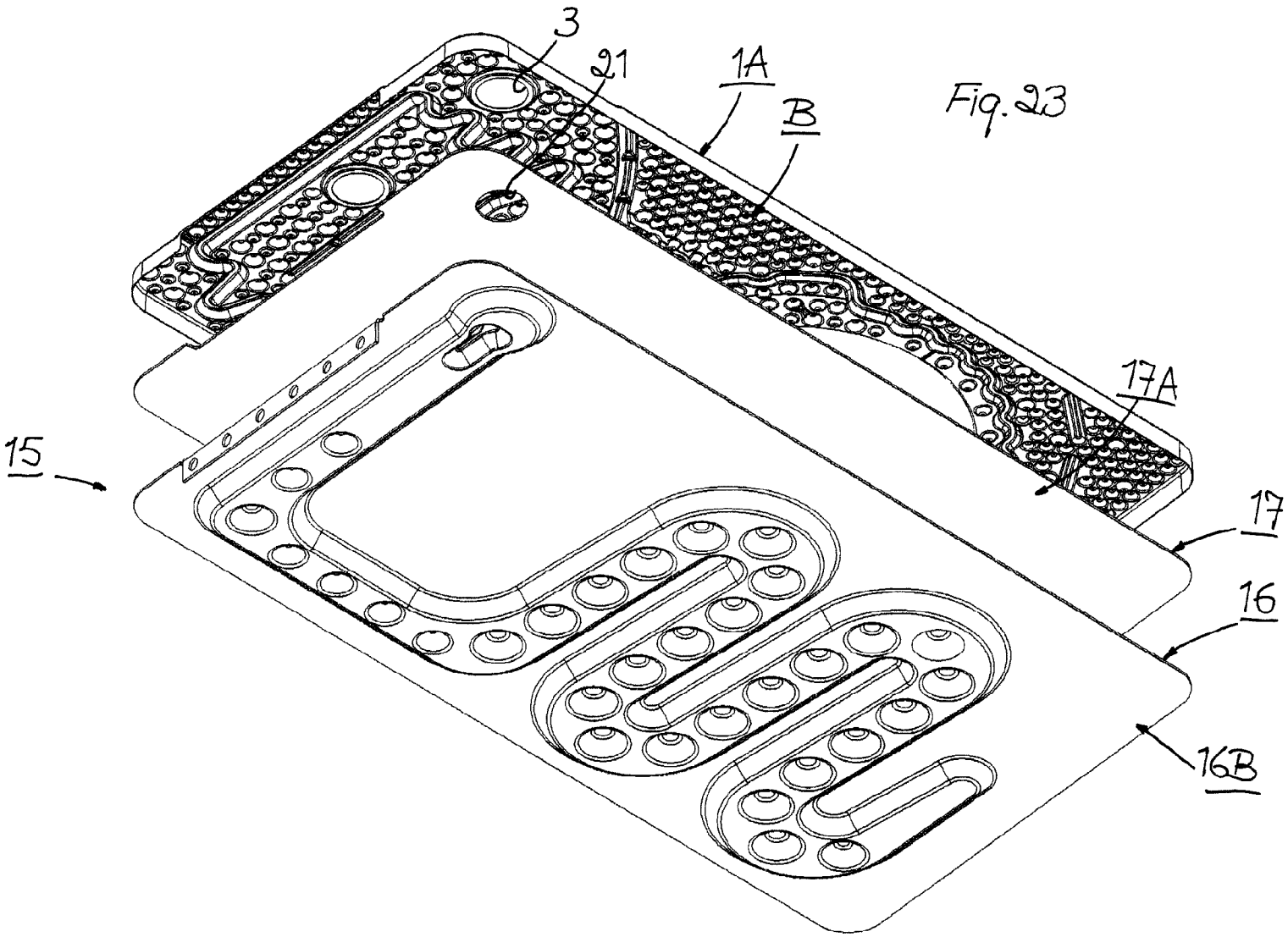
FIG. 23 is another exploded perspective view illustrating the (second) heat transferring surface of the second plate for a heat exchange arrangement as well as the end plate and the flow transition means in the form of the back plate from the opposite side thereof.

In order to enable the feedback of the first medium for the second cooling step of the second medium, the first outlets 5*a* for the first medium stand in flow communication with the second inlets 3*a* for the first medium by means of an external flow transition means 15. This means, in other words, that each first outlet 5*a* for the first medium defined between respective two first outlet portholes 5 in two plates 1, 1A in the stack of plates 1, 1A, communicate with the external flow transition means 15 for transportation or feeding of said first medium, through said flow transition means, to each second inlet 3*a* for the first medium defined between respective two second inlet portholes 3 in two plates in the stack of plates. The flow transition means 15 may be configured as e.g. a back plate 16 as illustrated in FIGS. 22 and 23 or as e.g. a pipe (not illustrated) or as another suitable means for transportation or feeding of the first medium from said first outlets 5*a* to said second inlets 3*a* therefor.

When the flow transition means 15 is configured as a back plate 16, it may be connected to the stack of heat exchange plates 1, 1A through an end plate 17 and thereby, on the side 16A thereof facing the end plate 17 for said stack of heat exchange plates, be configured with e.g. a flow transition channel 18 for said transportation or feeding of the first medium from said first outlets 5*a* to said second inlets 3*a* therefor. The flow transition channel 18 however, may have a double function. Except for the connection of the first and second flow paths C1 and C2 for the first medium to each other, it may also be used for cooling of said end plate 17 to the stack of heat exchange plates 1, 1A. Otherwise, the temperature of the end plate 17 might be too high during operation. By configuring the flow transition channel 18 such that it, as illustrated, encircles a part of the back plate 16 forming a wall for generating an enclosure for a combustion chamber for the second medium (gas) to burn, which combustion chamber is defined by the inlet portholes 4 for the second medium in the plates 1, 1A in the stack thereof, said combustion chamber is cooled via the end plate 17 particularly at the end thereof. In order to prolong the stay of the first medium in the flow transition channel 18, said channel may also have e.g. an entirely or partially sinusoidal or substantially sinusoidal shape or any other suitable shape between the first outlet porthole 5 for the first medium and the second inlet porthole 3 for the first medium of the plate 1, 1A. Furthermore, the flow transition channel 18 may be provided with dimples 19 of any suitable type or shape to create turbulence in said flow transition channel. As illustrated, the flow transition channel 18 forms a correspondingly shaped elevation on the opposite side of the back plate 16, i.e. the side 16B thereof facing away from the end plate 17, and the dimples 19 form correspondingly shaped depressions in said elevation (see FIG. 23).

As illustrated, the flow transition channel 18 may be open and cooperate with the end plate 17 such that said flow transition channel thereby is sealed in the sense that it forms an enclosed space for the first medium to flow through. The surface 17A of the end plate 17 facing the back plate 16 may accordingly be substantially planar and the opposite surface 17B of the end plate facing a heat exchange surface A or B of the heat exchange plate 1, 1A closest thereto in the stack thereof is configured such that it mates with said heat exchange surface. As illustrated, the surface 17B of the end plate 17 faces in the embodiment of FIGS. 22 and 23 the second heat exchange surface B of a second heat exchange plate 1A and said surface of the end plate is configured to be substantially planar, defining a second channel D for a second medium. Also, the end plate 17 is of course configured with apertures 20 and 21 mating with the first outlet porthole 5 for the first medium and the second inlet porthole 3 for the first medium respectively, of all heat exchange plates 1, 1A in the stack, in the illustrated embodiment with the first outlet porthole 5 and the second inlet porthole 3 respectively, of said second heat exchange plate 1A.

However, it is within the scope of the disclosure possible also to configure the back plate with a sealed flow transition channel from the beginning and thereby possibly avoid use of a separate end plate in the stack of heat exchange plates.

Similarly, when using a pipe as a flow transition means 15 for transportation or feeding of the first medium from the first outlets 5*a* to the second inlets 3*a* therefor, it is possible to avoid use of a separate end plate in the stack of heat exchange plates if the surface of the heat exchange plate 1 or 1A facing the pipe is suitably configured therefor, i.e. not configured for heat exchange. Otherwise, an end plate 17 configured as illustrated in FIGS. 22 and 23 may be used.

Thus, if the heat exchange arrangement comprises a stack of e.g. 20 plates 1, 1A, the first medium flowing from the first inlets 2*a* therefor through e.g. 10 different first flow paths C1 defined by the inner regions A1 of the first heat exchange surfaces A of respective two plates 1 and 1A in the stack of plates to the first outlets 5*a* for the first medium, will, when the heat exchange arrangement is in use, gather at the inlet to the flow transition channel 18 in the back plate 16 and flow through the flow transition channel to the second inlets 3*a*, separate there into e.g. 10 different second flow paths C2 defined by the outer regions A2 of the first heat exchange surfaces A of respective two plates 1 and 1A in the stack of plates and flow through said second flow paths to the second outlets 6*a* and finally from there leave the heat exchange arrangement.

The edges 1*a*-1*d* of the first and the second plates 1, 1A are folded away from the respective surface at an angle β greater than 75 degrees in the same direction (see e.g. FIG. 7). Accordingly, in the illustrated embodiments, the folds 13 of the first plates 1 are configured to surround the first heat transferring surfaces A thereof and the folds 13 of the second plates 1A are configured to surround the second heat transferring surfaces B thereof. When the plates 1, 1A are stacked on top of each other, the folds 13 overlap each other. Thus, the folds 13 are configured such that the first channel C is completely sealed at all edges and such that the second channel D is completely sealed at all but one edge, said one edge being only partially folded for defining an outlet 14*a* for the second medium to leave the heat exchange arrangement. In the illustrated embodiment, the outlet 14*a* for the second medium is defined at the edge 1*b* opposite to the edge 1*a* in close proximity to which the first and second outlets 5*a*, 6*a* for the first medium and the inlet 4*a* for the second medium are defined, i.e. at the edge close to which the first and second inlets for the first medium are defined. An outlet 14*a* is defined between recesses 14 which are formed by the partially folded edges 1*b*, i.e. in the folds 13 of two stacked plates 1, 1A of which the second heat transferring surfaces B face each other.

In use, the heat exchange arrangement is with advantage arranged such that the edges 1*b* of the plates 1, 1A forming the heat exchange arrangement and defining between them each outlet 14*a* for the second medium, are facing downwards. This while condensation of the second medium occurs primarily in the area of the plates just upstream of these outlets 14*a* and condensate will much easier flow out through the outlets 14*a* if they are facing downwards.

Figure 24:
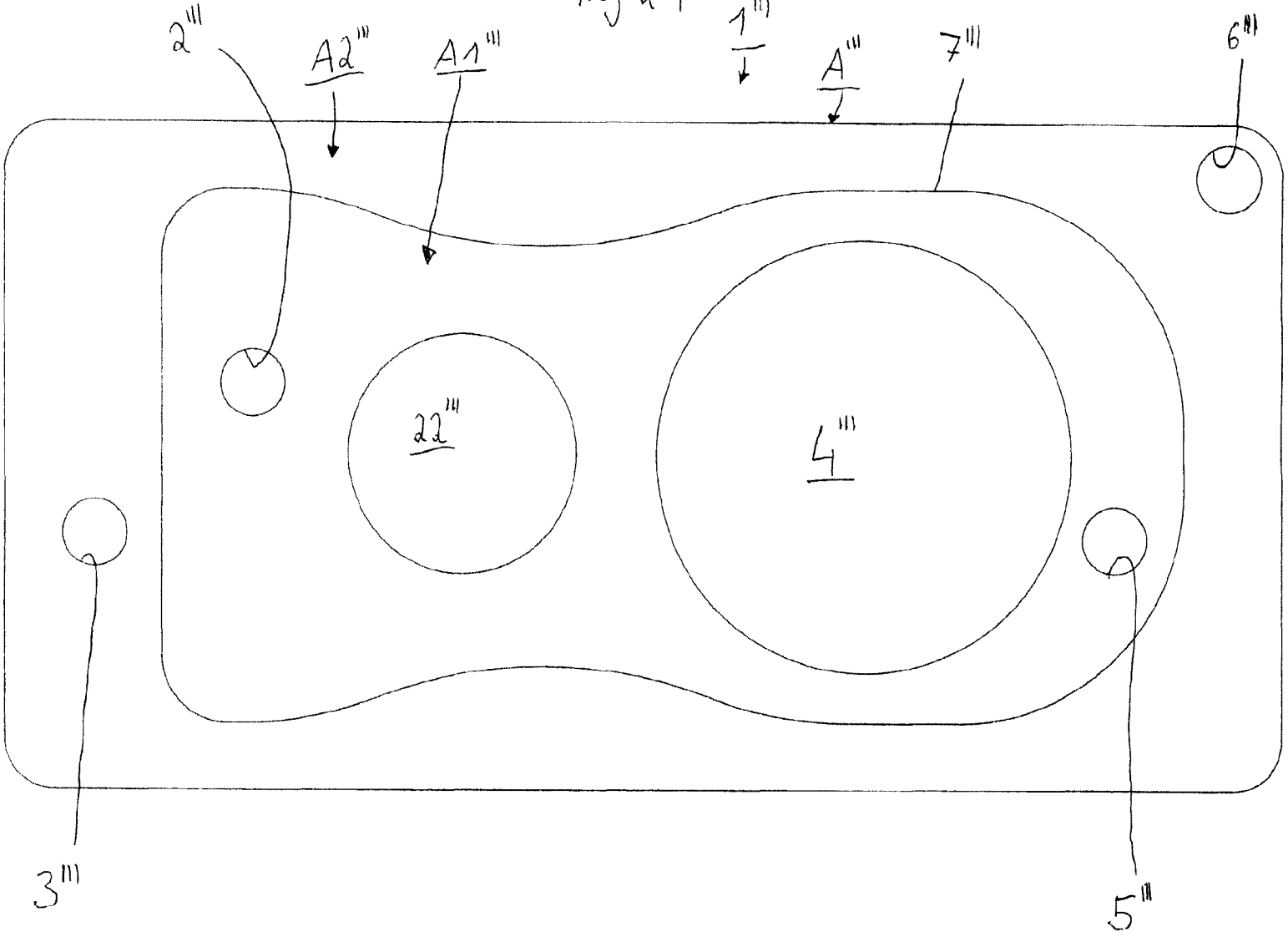
FIG. 24 is a very schematic plan view of a first heat transferring surface of a fourth general embodiment of a plate according to the disclosure for a heat exchange arrangement, said first heat transferring surface being arranged in use for contact with a first medium.

As schematically illustrated in the alternative embodiment of FIG. 24, the plate 1''' may be configured also with an outlet porthole 22''' for the second medium. The periphery of this outlet porthole 22''' may optionally, as the inlet porthole 4''' for the second medium, be folded at an angle of more than 75 degrees with respect to the first heat transferring surface A''' of the plate 1''', but may also have an angle less than 75 degrees and/or also be configured in other ways.

After assembly to a heat exchange arrangement, the outlet portholes 22''' for the second medium define between them outlets for the second medium. At this alternative embodiment, each second channel defined between second heat transferring surfaces of first and second plates as defined above is, similar to the first channel, completely sealed at all edges.

Figure 25:
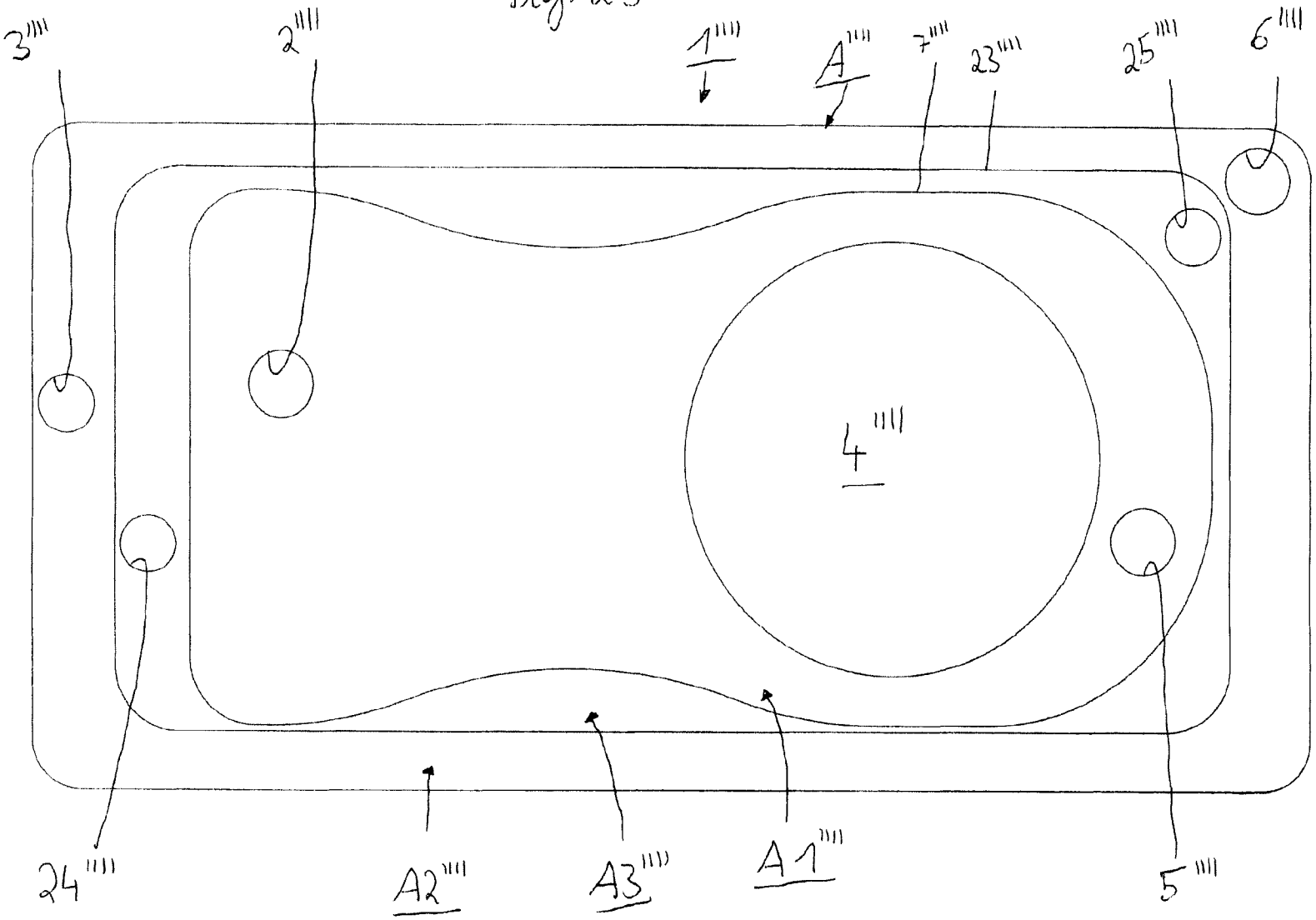
FIG. 25 is a very schematic plan view of a first heat transferring surface of a fifth general embodiment of a plate according to the disclosure for a heat exchange arrangement, said first heat transferring surface being arranged in use for contact with a first medium.

As schematically illustrated in FIG. 25 and if as indicated above further cooling of the second medium is required or desired by further feeding of the first medium through the first channel therefor, it is within the scope of the present disclosure to configure the first heat transferring surface A'''' of the plate 1'''' with at least two protrusions 7'''', 23'''', namely a protrusion 7'''' as described above and an additional protrusion 23'''' which surrounds said first protrusion. The two protrusions 7'''', 23'''' illustrated in FIG. 25 form both continuous and closed ridges which are arranged to divide said first heat transferring surface A'''' into the closed inner region A1'''', the outer region A2'''' and at least one closed intermediate region A3'''' between said inner and said outer region. The closed inner region A1'''' within protrusion 7'''' completely encloses the first inlet porthole 2'''' for the first medium, the first outlet porthole 5'''' for the first medium and the inlet porthole 4'''' for the second medium. The outer region A2'''' outside of protrusion 23'''' completely encloses the second inlet porthole 3'''' for the first medium and the second outlet porthole 6'''' for the first medium. The only intermediate region A3'''' illustrated in FIG. 25, defined between the two protrusions 7'''', 23'''', completely encloses an additional inlet porthole 24'''' for the first medium and an additional outlet porthole 25'''' for the first medium.

After assembly to a heat exchange arrangement, the protrusions, such as the two protrusions 7'''', 23'''' illustrated in FIG. 25, on the first heat transferring surface A'''' of the first plate 1'''', and on the first heat transferring surface of a second plate which is a mirror copy of said first plate, are connected to each other to separate each first channel into the first and second flow paths as defined above as well as into at least one intermediate flow path for the first medium between the first and the second flow paths. Since only two protrusions are provided in FIG. 25, only one intermediate flow path is defined between said first and second flow paths. As already mentioned above, each first flow path is configured in use to direct a flow of the first medium from the first inlet to the first outlet inside the inner region A1'''' and each second flow path is configured in use to direct the flow of the first medium from the second inlet to the second outlet in the outer region A2''''. Similarly, each intermediate flow path is configured in use to direct the flow of the first medium from an additional inlet to an additional outlet inside the at least one intermediate region A3''''. The additional inlet and outlet are defined between the additional inlet portholes 24'''' and outlet portholes 25'''' for the first medium respectively, which are provided on each intermediate region A3'''' on the first and second plates.

If one or more intermediate flow paths as described above are provided, the external flow transition means 15 for transportation or feeding of the first medium must of course be configured in accordance therewith in order to permit the desired recirculation of the first medium for optimum cooling of the second medium. Thus, in a heat exchange arrangement comprising a stack of first plates 1'''' as illustrated in FIG. 25 and mating second plates which are mirror copies of said first plates, the external flow transition means will be configured to bring the first outlets for the first medium into flow communication with the additional inlets defined between the additional inlet portholes 24'''' and thereafter bring the additional outlets defined between the additional outlet portholes 25'''' in flow communication with the second inlets for the first medium. On the other hand, it is also possible to configure the external flow transition means to bring the first outlets for the first medium into flow communication with the second inlets and thereafter bring the second outlets in flow communication with the additional inlets for the first medium. In case more than one intermediate flow path is provided, there are many more alternatives of how to configure the external flow transition means 15 than those described above.

It is obvious to a skilled person that the plate according to the present disclosure for the heat exchange arrangement can be modified and altered within the scope of subsequent claims 1-10 without departing from the idea and object of the disclosure. Thus, it is possible to e.g. give the protrusion which divides the first heat transferring surface of each plate into a closed inner region as well as an outer region or the protrusions which divide the first heat transferring surface of each plate into a closed inner region, one or more closed intermediate regions and an outer region any suitable shape in order to provide for an optimum flow of the first medium through said regions. It is also possible to configure the one or more protrusions and locate the inlet and outlet portholes for the first and second media such that the plates are symmetric and only one type of plate will be needed. The size and shape of the portholes can vary. The size and shape of the plates can vary. The plates can instead of being shaped as a parallelogram (e.g. square, rectangular, rhomboid, rhombus) be e.g. trapezoid, with two opposing parallel sides or edges and two opposing non-parallel sides or edges.

It is obvious for a skilled person that the heat exchange arrangement according to the present disclosure can also be modified and altered within the scope of subsequent claims 11-20 without departing from the idea and object of the disclosure. Accordingly, the number of plates in the heat exchange arrangement can e.g. vary. Even if the preferred number of plates can be e.g. 20, it is of course also possible to stack more than 20 and less than 20 plates in a heat exchange arrangement according to the present disclosure. Also, the plates and the various portions and parts thereof can vary in size, as mentioned, such that e.g. the height of the first and second channels for the first and second media respectively, can vary and accordingly, the height of the elevations formed by the dimples as well.

The invention claimed is:

1. A plate for a heat exchange arrangement for the exchange of heat between a first and a second medium, wherein:

the plate has a first heat transferring surface arranged in use to be in contact with the first medium and a second heat transferring surface arranged in use to be in contact with the second medium;

the plate is configured with a first inlet porthole for the first medium and an inlet porthole for the second medium, and a first outlet porthole for the first medium;

the plate comprises at least a second inlet porthole for the first medium and at least a second outlet porthole for the first medium, the first heat transferring surface is configured with at least one protrusion forming a continuous and closed ridge which divides said heat transfer surface into at least a closed inner region and an outer region outside the closed inner region;

the inner region completely encloses the first inlet porthole for the first medium, the first outlet porthole for the first medium and the inlet porthole for the second medium;

the second inlet porthole for the first medium and the second outlet porthole for the first medium are located in the outer region, the inlet porthole for the second medium is located between the first inlet porthole and the first outlet porthole for the first medium; and the protrusion is configured to define a restriction between the first inlet porthole for the first medium and the inlet porthole for the second medium, the restriction being defined by a narrowed part of the inner region that is more narrow that parts of the inner region immediately adjacent the restriction to guide flow of the first medium towards and around the inlet porthole for the second medium.

2. The plate for a heat exchange arrangement according to claim 1, wherein:

the plate is shaped substantially as a parallelogram; and wherein the inlet porthole for the second medium and the first and second outlet portholes for the first medium are located in close proximity to one edge of the plate and the first and second inlet portholes for the first medium are located in close proximity to the opposite edge of the plate.

3. The plate for a heat exchange arrangement according to claim 2, wherein:

the first outlet porthole and the first inlet porthole for the first medium are located in close proximity to the centre portion of said one edge and said opposite edge respectively, of the plate.

4. The plate for a heat exchange arrangement according to claim 2, wherein:

the second outlet porthole and the second inlet porthole for the first medium are located substantially diagonally opposite each other in close proximity to said one edge and said opposite edge respectively, of the plate.

5. The plate for a heat exchange arrangement according to claim 1, wherein:

the inner region and the outer region on the first heat transferring surface of the plate are configured with broken longitudinal protrusions for controlling the flow of the first medium.

6. The plate for a heat exchange arrangement according to claim 1, wherein:

the first heat transferring surface of the plate is configured with at least two protrusions forming continuous and closed ridges which are arranged to divide said first heat transferring surface into the closed inner region, the outer region and at least one closed intermediate region between said inner and said outer region; and the inner region completely encloses the first inlet porthole for the first medium, the first outlet porthole for the first medium and the inlet porthole for the second medium, the outer region completely encloses the second inlet porthole for the first medium and the second outlet port-hole for the first medium and the at least one intermediate region completely encloses an additional inlet porthole for the first medium and an additional outlet porthole for the first medium.

7. The plate for a heat exchange arrangement according to claim 1, wherein:

the plate is configured with an outlet porthole for the second medium.

8. The plate for a heat exchange arrangement according to claim 1, wherein:

the periphery of the inlet porthole for the second medium is folded at an angle of more than 75 degrees with respect to the first heat transferring surface of the plate.

9. The plate for a heat exchange arrangement according to claim 8, wherein:

the first heat transferring surface includes a plurality of spaced apart dimples each forming an elevation; and the length of the fold is less than twice the height of the elevations formed by the dimples.

10. A heat exchange arrangement for the exchange of heat between a first and a second medium, comprising:

a plurality of first plates and a plurality of second plates, said second plates being mirror copies of said first plates;

each of said first plates comprising:

a first heat transferring surface arranged in use to be in contact with the first medium and a second heat transferring surface arranged in use to be in contact with the second medium;

a first inlet porthole for the first medium and an inlet porthole for the second medium, and a first outlet porthole for the first medium;

a least a second inlet porthole for the first medium and at least a second outlet porthole for the first medium;

the first heat transferring surface being configured with at least one protrusion forming a continuos and closed ridge which divides said heat transfer surface into at least a closed inner region and an outer region outside the closed inner region;

the inner region completely enclosing the first inlet porthole for the first medium, the first outlet porthole for the first medium and the inlet porthole for the second medium;

the second inlet porthole for the first medium and the second outlet porthole for the first medium being located in the outer region;

the first and the second plates being alternately stacked to form a repetitive sequence of a first channel for the first medium and a second channel for the second medium;

each first channel being defined by the first heat transferring surface of the first plate and the first heat transferring surface of the second plate and each second channel by the second heat transferring surface of the first plate and the second heat transferring surface of the second plate;

the first and the second inlet portholes for the first medium on the first and the second plates defining between them first and second inlets respectively, for the first medium;

the first and the second outlet portholes for the first medium on the first and the second plates defining between them first and second outlets respectively, for the first medium;

the inlet portholes for the second medium on the first and the second plates defining between them inlets for the second medium;

the protrusions on the first heat transferring surfaces of the first and the second plates being connected to each other to separate each first channel into at least first and second flow paths for the first medium; and each first flow path being configured in use to direct a flow of the first medium from the first inlet to the first outlet inside the inner region and each second flow path is configured in use to direct the flow of the first medium from the second inlet to the second outlet in the outer region.

11. The heat exchange arrangement according to claim 10, wherein:

the protrusions on the first heat transferring surfaces of the first and the second plates are connected to each other to separate each first channel into the first and second flow paths and into at least one inter-mediate flow path for the first medium between the first and second flow paths; and each intermediate flow path is configured in use to direct a flow of the first medium from an additional inlet to an additional outlet inside the at least one inter-mediate region, which additional inlet and outlet are defined between the additional inlet portholes and outlet portholes for the first medium respectively, on the first and second plates.

12. The heat exchange arrangement according to claim 10, wherein:

the edges of the first and the second plates are folded away from the respective surface at an angle greater than 75 degrees in the same direction; wherein each first channel and each second channel is completely sealed at all edges; and the outlet portholes for the second medium on the first and the second plates define between them outlets for the second medium.

13. The heat exchange arrangement according to claim 11, wherein:

the edges of the first and the second plates are folded away from the respective surface at an angle greater than 75 degrees in the same direction;

wherein each first channel is completely sealed at all edges; and each second channel is completely sealed at all but one edge, said one edge being partially folded for defining an outlet for the second medium.

14. The heat exchange arrangement according to claim 13, wherein:

the outlets for the second medium are defined at the edges opposite to the edges in close proximity to which the inlets for the second medium are defined.

15. The heat exchange arrangement according to claim 10, wherein:

the first outlets for the first medium stand in flow communication with the second inlets for the first medium by means of an external flow transition means.

16. The heat exchange arrangement according to claim 15, wherein:

the external flow transition means is configured as a back plate; and wherein the back plate is configured with a flow transition channel for bringing the first outlets for the first medium in flow communication with the second inlets therefor.

17. The heat exchange arrangement according to claim 16, wherein:

the flow transition channel is configured to encircle a part of the back plate forming a wall for generating an enclosure for a combustion chamber for the second medium, which combustion chamber is defined by the inlet portholes for the second medium in the plates.

18. The heat exchange arrangement according to claim 16, wherein:

the flow transition channel has an entirely or partially sinusoidal or substantially sinusoidal shape.

19. The heat exchange arrangement according to claim 15, wherein: the external flow transition means is configured as a pipe.

20. A plate for a heat exchange arrangement for the exchange of heat between a first and a second medium, wherein:

the plate has a first heat transferring surface arranged in use to contact the first medium and a second heat transferring surface arranged in use to contact the second medium;

the plate includes a first inlet porthole for the first medium and an inlet porthole for the second medium, and a first outlet porthole for the first medium;

the plate comprises at least a second inlet porthole for the first medium and at least a second outlet porthole for the first medium, the first heat transferring surface is configured with at least one protrusion forming a continuous and closed ridge which divides the heat transfer surface into at least a closed inner region and an outer region outside the closed inner region;

the inner region completely encloses the first inlet porthole for the first medium, the first outlet porthole for the first medium and the inlet porthole for the second medium;

the second inlet porthole for the first medium and the second outlet porthole for the first medium are located in the outer region;

the first heat transferring surface of the plate includes at least two protrusions forming continuous and closed ridges which divide the first heat transferring surface into the closed inner region, the outer region and at least one closed intermediate region between the inner region and the outer region;

the inner region completely encloses the first inlet porthole for the first medium, the first outlet porthole for the first medium and the inlet porthole for the second medium;

the outer region completely encloses the second inlet porthole for the first medium and the second outlet port-hole for the first medium; and the at least one intermediate region completely encloses an additional inlet porthole for the first medium and an additional outlet porthole for the first medium.

* * * * *